US005745818A

United States Patent [19]

Kumasaka et al.

[11] Patent Number: 5,745,818

[45] Date of Patent: Apr. 28, 1998

[54] IMAGE FORMATION METHOD AND IMAGE FORMATION APPARATUS

[75] Inventors: Takao Kumasaka, Takahagi; Hisao Okada, Hitachi; Noboru Tokuyasu, Hitachi; Yuzuru Simazaki, Hitachi; Susumu Tateyama, Hitachi, all of Japan

[73] Assignees: Hitachi, Ltd.; Hitachi Koki Co., Ltd., both of Tokyo, Japan

[21] Appl. No.: 214,302

[22] Filed: Mar. 17, 1994

[30] Foreign Application Priority Data

Mar. 17, 1993 [JP] Japan ..... 5-056749

[51] Int. Cl.[6] ..... G03G 15/01

[52] U.S. Cl. ..... 399/40; 399/223

[58] Field of Search ..... 355/326 R, 327; 399/40, 223

[56] References Cited

U.S. PATENT DOCUMENTS

| | | | |
|---|---|---|---|
| 4,310,248 | 1/1982 | Meredith | 356/243 |
| 4,416,533 | 11/1983 | Tokunaga et al. | 355/326 X |
| 4,833,505 | 5/1989 | Furuya et al. | 355/326 |
| 4,860,048 | 8/1989 | Itoh et al. | 355/326 X |
| 4,961,094 | 10/1990 | Yamaoki et al. | 355/326 R |
| 5,030,996 | 7/1991 | Tajima et al. | 355/326 R X |
| 5,066,979 | 11/1991 | Goto et al. | 355/326 R X |
| 5,260,752 | 11/1993 | Fuma et al. | 355/326 R X |
| 5,365,325 | 11/1994 | Kumasaka et al. | 355/326 R |
| 5,406,313 | 4/1995 | Noami et al. | 355/327 X |

FOREIGN PATENT DOCUMENTS

| | | |
|---|---|---|
| 41 04 743 A1 | 9/1987 | Germany . |
| 37 07 026 A1 | 10/1987 | Germany . |
| 54-82242 | 6/1979 | Japan . |

*Primary Examiner*—Fred L. Braun

*Attorney, Agent, or Firm*—Antonelli, Terry, Stout, & Kraus, LLP

[57] ABSTRACT

An image formation method for forming an image of a plurality of colors through a charging step, an image exposing step, a developing step and a transferring step, wherein the image exposing step is made up of a first image exposing step and a second image exposing step, the developing step of at least one color is carried out after the first image exposing step, and in the subsequent second image exposing step, the toner image area formed by the developing step is exposed and charge latent images for forming toner images of the rest of the colors are formed while a potential of the toner image area is selectively shifted.

34 Claims, 20 Drawing Sheets

FIRST/SECOND DEVELOPMENT

SECOND EXPOSURE

THIRD/FOURTH DEVELOPMENT

○ --- 1ST COLOR TONER

△ --- 2ND COLOR TONER

● --- 3RD COLOR TONER

× --- 4TH COLOR TONER

FIRST/SECOND DEVELOPMENT

SECOND EXPOSURE

THIRD/FOURTH DEVELOPMENT

○ --- 1ST COLOR TONER

△ --- 2ND COLOR TONER

● --- 3RD COLOR TONER

× --- 4TH COLOR TONER

FIRST/SECOND DEVELOPMENT

SECOND EXPOSURE

THIRD/FOURTH DEVELOPMENT

○ --- 1ST COLOR TONER

△ --- 2ND COLOR TONER

● --- 3RD COLOR TONER

× --- 4TH COLOR TONER

FIRST DEVELOPMENT

SECOND EXPOSURE

SECOND/THIRD DEVELOPMENT

FOURTH DEVELOPMENT

○ --- 1ST COLOR TONER

△ --- 2ND COLOR TONER

● --- 3RD COLOR TONER

× --- 4TH COLOR TONER

FIRST DEVELOPING STEP

POTENTIAL REGULATION STEP

SECOND/THIRD DEVELOPING STEP

FOURTH DEVELOPING STEP o --- 1ST COLOR TONER

Δ --- 2ND COLOR TONER

● --- 3RD COLOR TONER

× --- 4TH COLOR TONER

FIRST/SECOND DEVELOPMENT

THIRD DEVELOPMENT

SECOND EXPOSURE

FOURTH DEVELOPMENT o ---1ST COLOR TONER

Δ ---2ND COLOR TONER

● ---3RD COLOR TONER x ---4TH COLOR TONER

FIRST DEVELOPING STEP

POTENTIAL REGULATION STEP

SECOND/THIRD DEVELOPING STEP

FOURTH DEVELOPING STEP

○ --- 1ST COLOR TONER

△ --- 2ND COLOR TONER

● --- 3RD COLOR TONER

× --- 4TH COLOR TONER

FIRST/SECOND DEVELOPING STEP

THIRD DEVELOPING STEP

POTENTIAL REGULATION STEP

FOURTH DEVELOPING STEP o --- 1ST COLOR TONER

Δ --- 2ND COLOR TONER

● --- 3RD COLOR TONER x --- 4TH COLOR TONER

FIRST/SECOND DEVELOPMENT

SECOND EXPOSURE

THIRD DEVELOPMENT

THIRD EXPOSURE

FOURTH DEVELOPMENT

IMAGE FORMATION METHOD AND IMAGE FORMATION APPARATUS

BACKGROUND OF THE INVENTION

This invention relates to an image formation method and an image formation apparatus. More particularly, the present invention relates to an image formation method and an image formation apparatus which will be suitable for effecting multi-color printing by forming charge images on a latent image support.

So-called "one-path color image formation apparatuses" according to the prior art which effect color printing while a photosensitive body rotates once can be broadly classified into the following two systems.

(1) A system wherein four sets of image formation units each comprising a charging unit, an exposing unit and a developing unit are disposed around a photosensitive body, and image formation steps are repeated to form a four-color toner image.

(2) A system wherein a charging unit 2, exposure 3 and developing units 4, 5, 7, 8 are disposed around a photosensitive body 1 as shown in FIGS. 7 and 8 of the accompanying drawings, charge images of five potential levels ($Vi_1<Vi_2<Vi_3<Vi_4<V_0$ in FIG. 8) are formed by one exposing operation by the exposure 3 after charging by the charging unit 2, developing biases are then raised sequentially ($Vb_1<Vb_2<Vb_3<V_{b4}$ in FIG. 8) by the developing units 4, 5, 7, 8, an inverse developing step is carried out so as to cause a toner of each color having the same polarity as that of the charge image to adhere to portions from which the charge is extinguished, and a color image is thus formed. (Note that explanation of other components having respective reference numerals attached thereto is omitted here since they will be explained later.)

The latter is described in detail in JP-A-54-82242.

SUMMARY OF THE INVENTION

However, the one-path color image formation apparatuses according to the prior art described above are not free from the following drawbacks.

The system (1) which disposes four sets of the image formation units each comprising the charging unit, the exposing unit and the developing unit around the photosensitive body and repeats the image formation steps requires the same number of charging, exposing and developing units as the number of required colors. Therefore, the color image formation apparatus is likely to become great in size. The single exposure five-level system (2) shown in FIGS. 7 and 8 has the advantage that the number of each of the charging and exposing units may be only one. However, in the three developing steps of the second to fourth developing steps, the developing bias of a subsequent stage must be higher than the potential of the toner image formed at a preceding stage. (For example, in the developing steps of the second developing step et seq. in FIG. 8, $Vt_1<Vb_2$, $Vt_2<Vb_3$, $Vt_3<Vb_4$ when $Vt_1$ to $Vt_4$ are the toner image potentials and $Vb_1$ to $Vb_4$ are the developing biases, respectively.) Accordingly, the toner(s) of the subsequent stage(s) is likely to mix into the toner image(s) formed at the preceding stage(s), so that undesired color mixture occurs. A method which forms a color image using only normal development for the developing steps may be conceivable, but undesirable color mixture is similarly likely to occur in the three developing steps of the second to fourth developing steps. Further, a method which employs normal development and inverse development in mixture for the developing steps may also be conceivable, but the problem of undesirable color mixture is also likely to occur in the subsequent two developing steps in which the step of repeating inverse development and the step of repeating normal development are carried out.

It is an object of the present invention to provide a color image formation method and a color image formation apparatus which can eliminate the drawbacks described above, and can achieve clear multi-color printing at a high speed.

It is another object of the present invention to provide a compact color image formation apparatus capable of effecting one-path color printing.

In an image formation method for forming a multi-color image through a charging step, an exposing step, a developing step and a transferring step, the object of the present invention described above can be achieved by a method wherein the exposing step includes a plurality of steps, the developing step of at least one color is carried out after the first exposing step, and in the subsequent exposing step(s), the toner image area formed by the developing step of at least one color is exposed and charge latent images for forming the toner images of the other colors are formed while the potential of the toner image area is selectively shifted.

In an image formation apparatus including a latent image support, a charging unit for the latent image support, an exposing unit for forming charge latent images on the latent image support, a developing unit for forming toner images of a plurality of colors from the charge latent images and a transferring unit for transferring the toner images to a to-be-transferred member, the objects of the invention described above can be accomplished by an image formation apparatus wherein the exposing unit includes a first exposing unit and a second-exposing unit, and the second exposing unit forms charge latent images for the toner images of the rest of colors while shifting selectively a potential of a toner image area of at least one color formed on the charge latent image area by the first exposing unit.

In an image formation method for forming an image of a plurality of colors through a charging step, an exposing step, a developing step and a transferring step, the objects of the present invention can be accomplished by an image formation method wherein the exposing step for forming a charge latent image on a latent image support forms the charge latent image to have a shape of a plurality of triangular dots in such a manner that positions of apexes of the dots are mutually opposite in a sub-scanning direction of exposure between the dots adjacent to one another in a main scanning direction of exposure.

In the present invention, a toner image area of at least one color, which has already been formed, is further exposed in an exposing step after the first exposing step so as to selectively shift the potential of the toner image area. Accordingly, color mixture in the subsequent developing step can be prevented. In other words, the present invention can generate a potential distribution by effecting regulation of the toner image potential, the background area potential and the latent image area potential and the formation of the latent images, whenever necessary, by the subsequent exposing steps so that the development can be carried out by using developing biases higher than the potentials of the toner image area, the background area and other latent images at the time of subsequent normal development and at the same time, by using developing biases lower than the potentials of the toner image area, the background area and other latent images at the time of inverse development. Accordingly, color mixture does not occur, and a full color image can be formed by synthesizing the first to fourth color toner images, for example. For this reason, the present invention can perform clear full color printing by a one-path process.

In the present invention, the one-dot latent image shape is triangular, and the positions of the apexes are mutually opposite in the sub-scanning direction between the dots adjacent to one another in the main scanning direction. When one dot of an arbitrary color is taken into consideration, therefore, three remaining colors can be uniformly arranged adjacent to this dot in both main and sub-scanning directions. Accordingly, full color printing having high reproducibility of intermediate tones can be achieved by the combination of the four colors.

BRIEF DESCRIPTION OF THE DRAWINGS

These and other objects, features and advantages of the present invention will be understood more clearly from the following detailed description with reference to the accompanying drawings, wherein.

DESCRIPTION OF THE PREFERRED EMBODIMENTS

Figure 1:
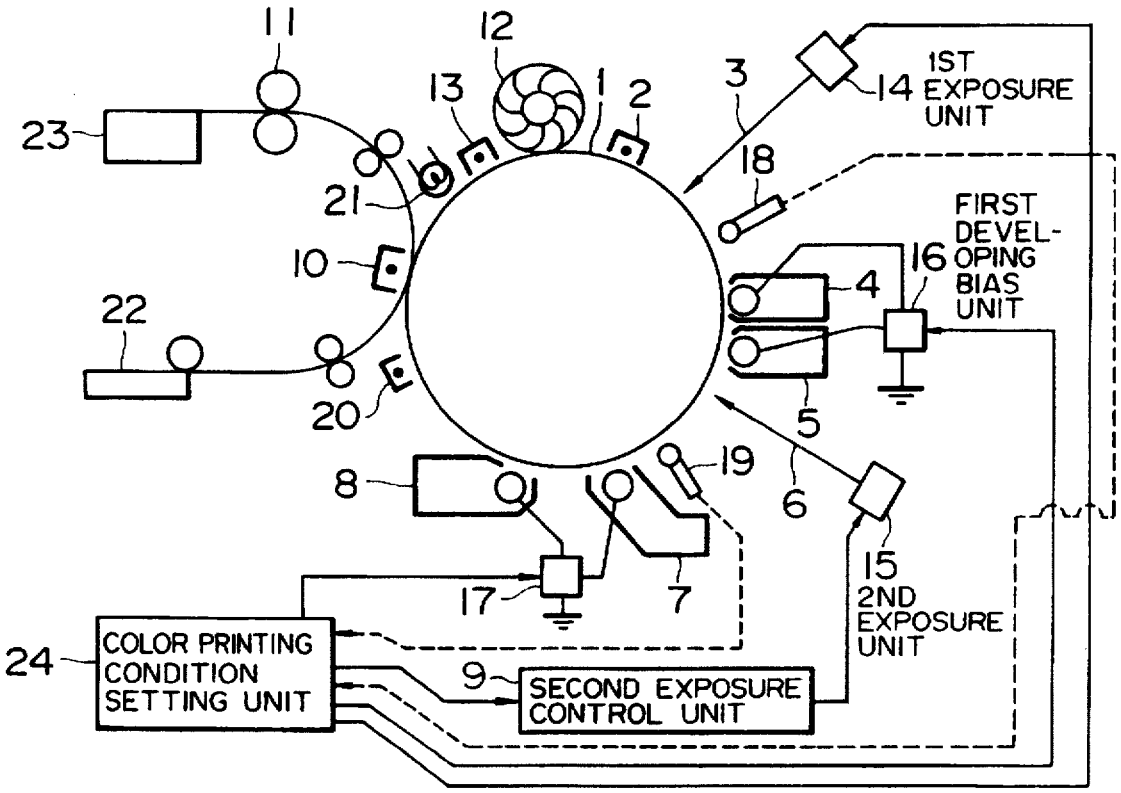
FIG. 1 is a schematic view showing an image formation apparatus according to an embodiment of the present invention.

An image formation apparatus according to an embodiment of the present invention will be explained with reference to FIG. 1. Charging unit 2, first exposure 3, first developing unit 4, second developing unit 5, second exposure 6, third developing unit 7, fourth developing unit 8, pre-transfer charging unit 20, transferring unit 10, fixing unit 11, a cleaner 12, change elimination lamp 21 charge elimination corona unit 13 are sequentially disposed around a photosensitive body 1 as an example of a latent image support. Further, surface potentiometers 18, 19 and a second exposure control unit 9 for controlling the second exposure are disposed around the photosensitive body 1. It will be hereby assumed that the first to fourth colors are yellow, magenta, cyan and black, respectively. The kind of the color of the first color toner is selected or the wavelength of irradiation light is set so that the rays of light emitted from the second exposure 6 can be transmitted through the first color toner, and a four-color toner image is formed on the photosensitive body 1 by the following image formation method.

In the drawing, reference numerals 14 and 15 denote first and second exposure units, 16 and 17 are first and second developing bias units, 22 is a sheet hopper, 23 is a sheet stacker, and 24 is a color printing condition setting unit.

Figure 2A:
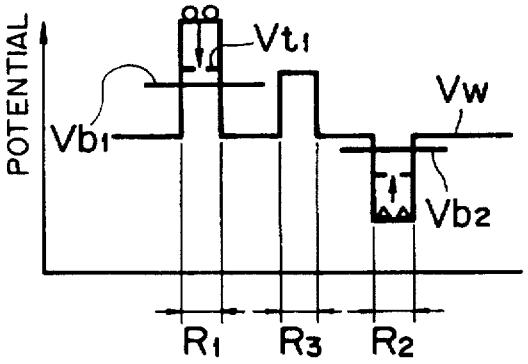
FIGS. 2A, 2B and 2C are diagrams each showing a distribution of a surface potential in an image formation method according to the embodiment of the present invention shown in FIG. 1.
Figure 2B:
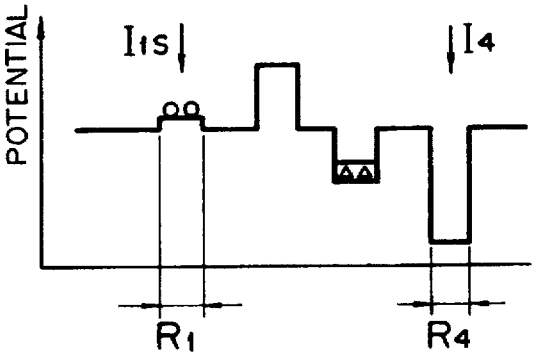
Figure 2C:
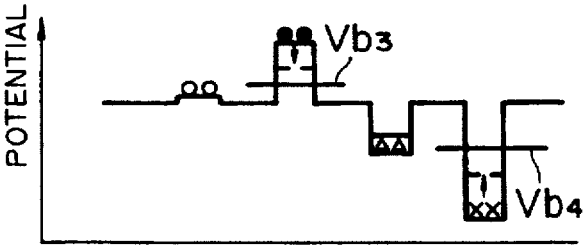

FIGS. 2A to 2C are diagrams showing corresponding surface potentials.

① First of all, charge images of four levels are formed by charging and the first exposure. These images correspond to a first charge image (region $R_1$), a third charge image (region $R_3$), a background area (region having a potential $V_w$) and a second charge image (region $R_2$) from a higher level in the order named, respectively.

② Normal development of the first charge image (region $R_1$) having a greater electrostatic contrast (a higher potential level) among the first and third charge images is carried out by applying a bias $Vb_1$ by the first developing unit 4, and the first color toner (for example, the yellow toner) is caused to adhere. In the second developing operation for forming the second color toner image, inverse development is carried out by applying a lower bias $Vb_2$ than the potential $Vt_1$ of the first color toner image portion and the potential of the third latent image area in order to prevent color mixture (FIG. 2A).

③ Next, light having an intensity $I_1s$ is irradiated by the second exposure 6 to the first color toner image area (region $R_1$) so that the potential of the first color toner image area ($R_1$) is substantially equal to the background area potential $V_w$. Then, fourth image exposing (intensity $I_4$) is effected to form the fourth charge image in the region $R_4$. This image exposing (intensity $I_4$) is set so that the potential of the fourth charge image (region $R_4$) is sufficiently lower than the potential of the second toner image area (region $R_2$). The background area potential $V_w$, the potential of the first color toner image area (region $R_1$) after second image exposing and the potential of the second color toner image area (region $R_2$) are measured by the surface potentiometers 18, 19, and the exposure intensities $I_1s$, $I_4$ may be controlled on the basis of the measurement values (FIG. 2B).

④ Normal development of the third charge image is carried out by the third developing unit 7 and the third color toner (e.g. cyan toner) is allowed to adhere, forming thereby the third color toner image. The third color toner does not adhere to other image regions because the third charge image and the third developing bias potential $Vb_3$ have higher potentials than the potentials of the first and second color toner images irrespective of the polarity of the first and second toners.

⑤ Inversion development of the fourth charge image (region $R_4$) is carried out by the fourth exposing unit 8 and the fourth color toner (e.g. black toner) is caused to adhere, thereby forming the fourth color toner image. The fourth color toner does not adhere to the first to third toner image areas because the fourth charge image and the fourth developing bias voltage $Vb_4$ are lower than the first to third color toner image potentials (FIG. 2C).

⑥ The four-color toner image is formed on the photosensitive body by the steps ① to ⑤.

⑦ The polarities of the four color toner images are converted to a single polarity by the pre-transfer charging unit 20 for generating AC+DC corona, and the image is then transferred to a sheet as a to-be-transferred member by the transferring unit 10.

⑧ The four-color toner image is thermally fused and fixed to the sheet by the fixing unit 11.

In the manner described above, this embodiment can execute clear full color printing in one path process.

The explanation will be supplemented on the second exposing step which is carried out at a pre-stage of the third development. The surface potentiometers 18, 19 are disposed immediately in front of the first and third developing units 4, 7, respectively, so as to measure the background area potential Vw, the potential of the first color toner image area (region $R_1$) after the second exposing and the potential of the second color toner image area (region $R_2$). The exposure intensities $I_1s$ and $I_4$ can be controlled on the basis of these measurement values by storing the detection signals of the surface potentials in a memory unit of the color printing condition setting unit 24, setting the second exposing control condition on the basis of the detection values of the surface potentials, transmitting them to the second exposure control unit 9 and controlling the second exposure unit 15.

Incidentally, the color printing condition setting unit 24 sets the conditions of the first to fourth developing biases on the basis of the detection values of the surface potentials, transmits them to the first and second developing bias units 16 and 17 to control the developing biases, monitors the initial charging potential by the surface potentiometer 18, and controls the charging unit 2 so as to achieve the predetermined potential.

In the construction shown in FIG. 1, the third and fourth developing units 7, 8 are disposed at a lower portion and scattering toners are likely to be deposited on them. For this reason, color toners having low lightness (for example, cyan or black) are preferably used for the third and fourth color toners.

In the construction described above, the second image exposing unit for regulating the surface potential of the photosensitive body (the toner image and the latent image potentials) is disposed on the upstream side of the third developing process for effecting the second normal development, in order to regulate the surface potential immediately before the third development. Accordingly, the third developing bias can be set to a potential equal to, or higher than, the first color toner image potential, and color mixture does not occur at the time of the third development.

At the time of the fourth development for effecting the second inverse development, inverse development is carried out using the toner having the same polarity as the polarity at the time of the second development. However, since the inverse development is effected by applying the developing bias which is lower than the toner image potential formed by the second development, color mixture does not occur in the second color toner image. Further, since the fourth developing bias is lower than the potentials of the first and third charge images, the fourth color toner does not mix into the first and third color image areas. In other words, each of the first to fourth color toner images can express a single color image of yellow, magenta, cyan and black free from color mixture. Accordingly, a full color image can be formed by synthesizing these four color images, and this embodiment provides the effect that clear full color printing can be made in one path process.

Figure 3:
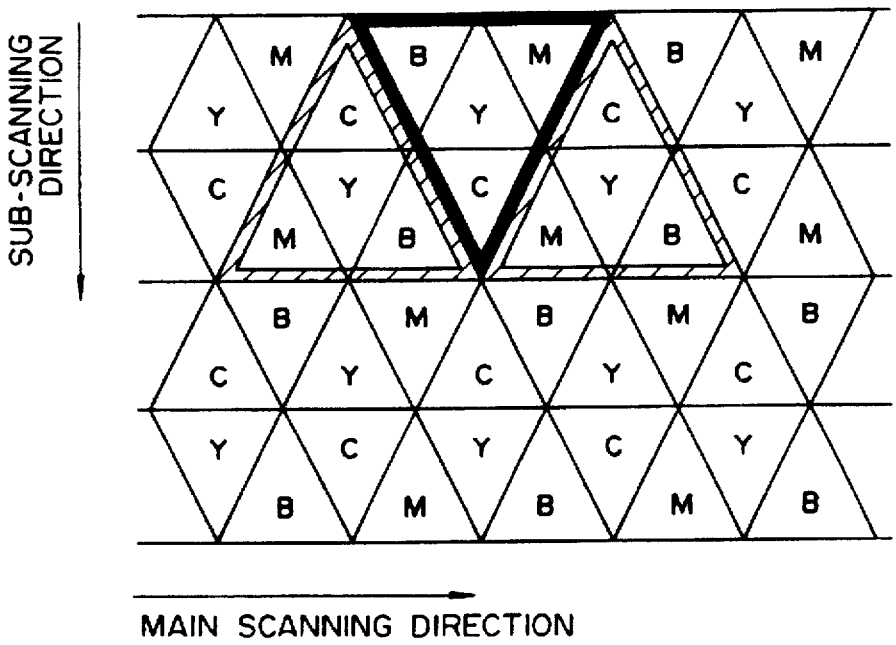
FIG. 3 is a diagram showing dot shapes used in the image formation method according to the embodiment of the present invention and the arrangement of each color dot.

Subsequently, one-dot latent image shape in the color image formation apparatus according to the present invention will be explained. As shown in FIG. 3, the one-dot latent image shape is a triangle, and the positions of the apexes between the dots adjacent to each other in the main scanning direction are opposite in the sub-scanning direction. For these reasons, when one dot having an arbitrary color (for example, Y inside thick lines or oblique lines in FIG. 4; yellow) is taken into consideration, other three colors (M: magenta, C: cyan, B: black) adjacent to Y in both main scanning direction and sub-scanning direction can be positioned uniformly adjacent to each side of the triangular dot. Accordingly, full color printing can be made with high reproducibility of intermediate tones prepared by the combinations of these colors.

Furthermore, various advantages such as extension of service life of the photosensitive body, saving of power, and so forth, can be accomplished by (1) not operating the potential regulation steps at the time of monochromatic printing, (2) changing the charging quantity of the first charging unit between monochromatic printing and multi-color printing, and (3) making different the developing bias for monochromatic printing from that of multi-color printing.

Incidentally, the problem of adhesion of the carrier to the second charge image having a low potential level (region $R_2$), which is likely to occur when a two-component developer is used, can be avoided by the use of a one-component developer as the developer for the first developing process.

Figure 4:
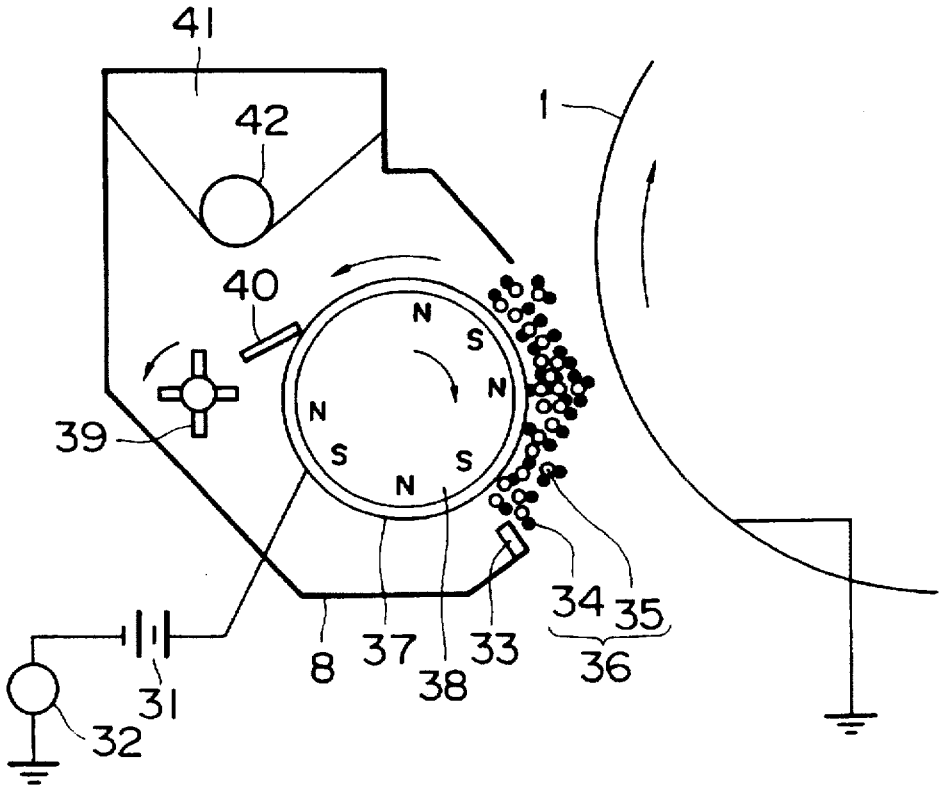
FIG. 4 is a sectional view of a developing unit used in the image formation apparatus according to the embodiment of the present invention shown in FIG. 1.

FIG. 4 illustrates an example of the second to fourth developing units 5, 7, 8 used for the color image formation apparatus according to the present invention, and represents an example wherein a two-component developing system is used as the developing system. The developer 36 comprises a toner 34 and a carrier 35, and a developing bias is applied to a developing sleeve 37. When the developer 36 and the photosensitive body 1 are out of contact, a D.C. component 31 as well as an A.C. component 32 may be applied but when the developer 36 comes into contact with the photosensitive body 1, only the D.C. component 31 may be applied. A developing sleeve 37 used hereby has the construction wherein it rotates at a speed about 1.0±0.5 times the peripheral speed of the photosensitive body 1 in the same rotating direction as the photosensitive body 1 and a magnet roll 38 rotates in an opposite direction to the photosensitive body 1, or the construction wherein only the developing sleeve 37 rotates in the same direction as the photosensitive body 1. The magnet roll 38 is constituted by arranging heteropolar or homopolar magnets having a magnetic pole pitch of 3 to 10 mm in the proximity of a portion opposing the photosensitive body.

The developer 36 is restricted into a predetermined thickness by a doctor plate 33 and is transferred to a developing portion opposing the photosensitive body 1.

Reference numeral 39 denotes a stirring member, and 40 denotes a scraper. Reference numeral 41 denotes a toner hopper and 42 does a feed roller.

The developing gap and the doctor gap are set to 800 μm and 250 μm, respectively, so that the developer 36 and the photosensitive body 1 are under the non-contact state. The peripheral speeds of the developing sleeve 37 and magnet roll 38 are set to 1.1 and 3.1 times the peripheral speed of the photosensitive body 1, respectively, and a D.C. component lower by about 100 V than the surface potential of the background area of the photosensitive body 1 and overlapped with an A.C. component of about 1 to 2 kV peak to peak is applied as the developing bias. Two-color printing is carried out under these conditions.

As a result, even when the density 1.2 (optical density) of the second color toner image is secured, the first color toner image is not disturbed, and more than 3% (occupying area ratio) of second color toner does not mix into the first color toner image.

When a resin carrier having a mean particle size of 50 to 120 μm is used as the carrier 35 and second development is effected, it has been found out that the tendency of the occurrence of stain of the background area due to adhesion of the carrier to the photosensitive body 1 can be prevented when the content of magnetic powder is from 70 to 90 wt %.

Figure 5A:
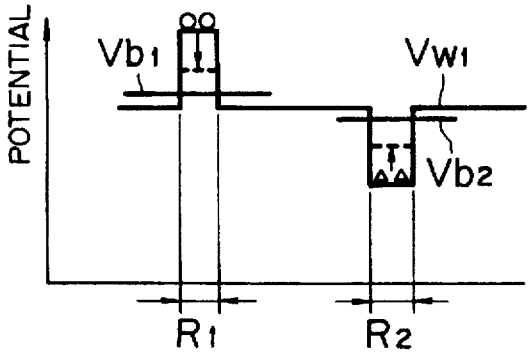
FIGS. 5A, 5B and 5C are diagrams each showing a distribution of a surface potential in the image formation method according to another embodiment of the present invention.
Figure 5B:
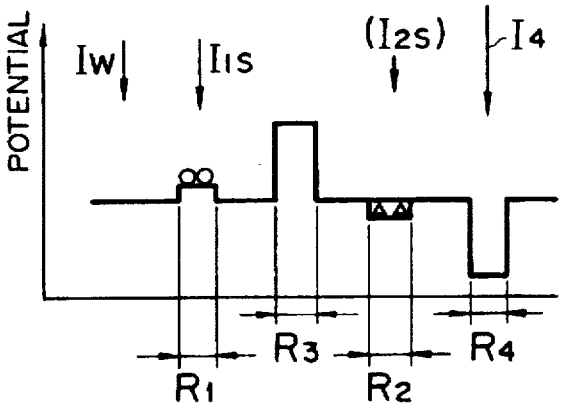
Figure 5C:
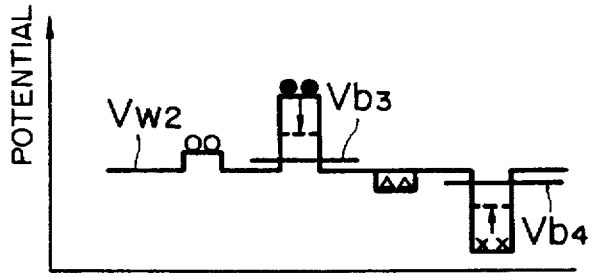

FIGS. 5A to 5C show another embodiment of the present invention. The difference of this embodiment from the embodiment shown in FIGS. 2A to 2C lies in that charge images of the three levels are formed by first image exposure, first and second developments are carried out, the charge image of the three levels is then formed by second image exposure, and third and fourth developments are carried out. The second image exposing process gets more complicated in comparison with the embodiment shown in FIGS. 2A to 2C, but there is the advantage that the first image exposing process can be simplified to a certain extent.

Figure 6A:
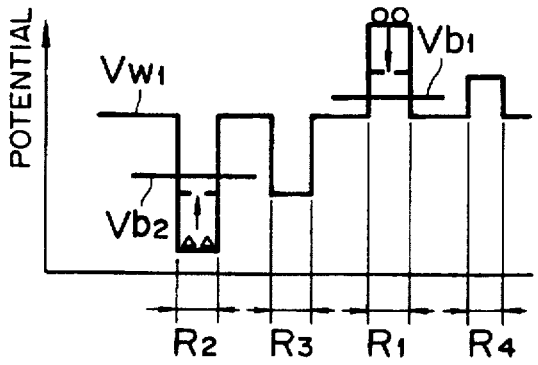
FIGS. 6A, 6B and 6C are diagrams each showing a distribution of a surface potential in the image formation method according to another embodiment of the present invention.
Figure 6B:
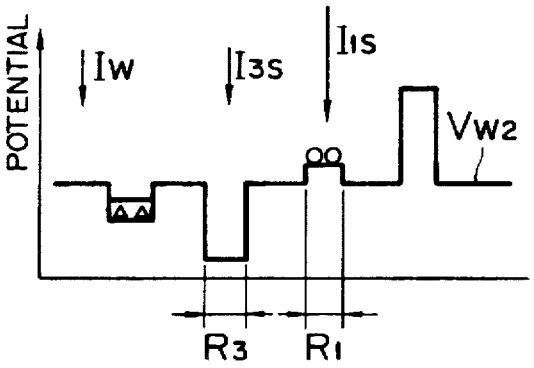
Figure 6C:
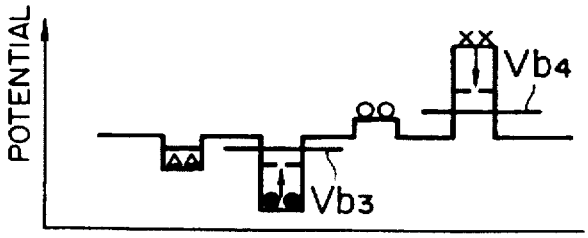
Figure 7:
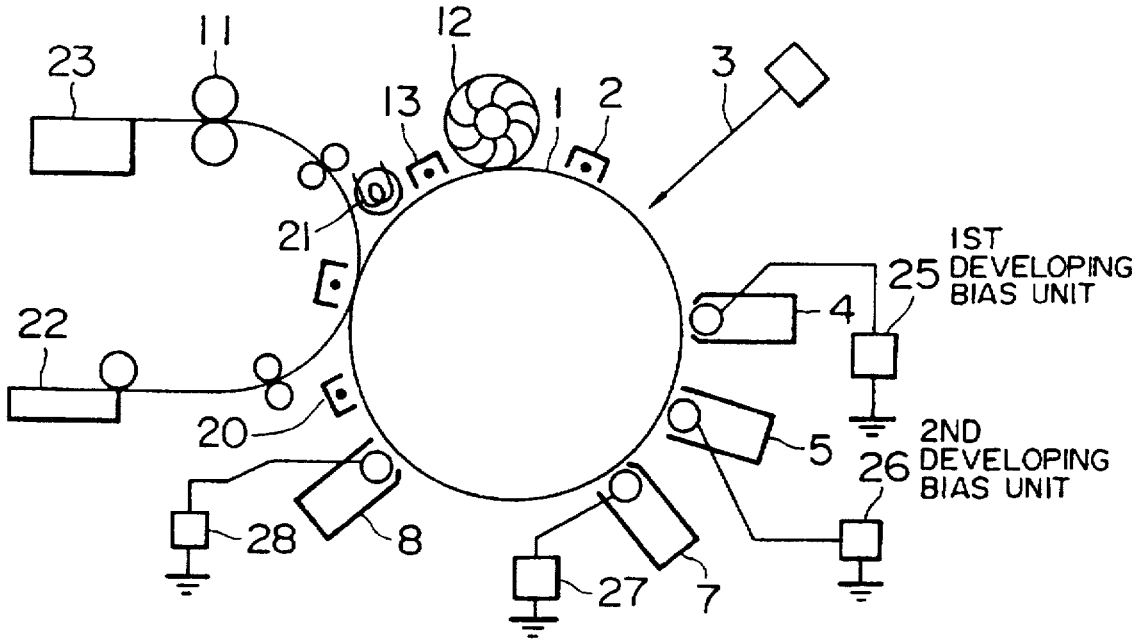
FIG. 7 PRIOR ART
FIG. 7 is a schematic view showing an image formation apparatus according to the prior art.
Figure 8:
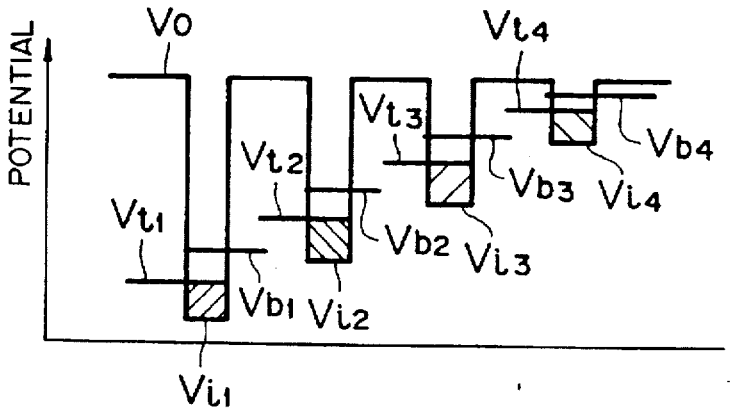
FIG. 8 PRIOR ART
FIG. 8 is a diagram showing a distribution of a surface potential in an image formation method according to the prior art.

FIGS. 6A to 6C show still another embodiment of the present invention. The difference of this embodiment from the embodiment shown in FIGS. 2A to 2C lies in that charge images of five levels are formed by the first image exposing process, first and second developments are carried out, charge images of three levels are formed by the second image exposing process, and then third and fourth developments are carried out. The first image exposing process becomes more complicated than in the embodiment shown in FIGS. 2A to 2C and the second image exposing process gets more complicated, too, but there can be obtained the advantage that mutual position errors of the charge image areas can be prevented because the first to fourth charge image areas ($R_1$, $R_2$, $R_3$, $R_4$) can be set by the first image exposing process.

The foregoing embodiments (potential distribution diagrams: FIGS. 2A to 2C, 5A to 5C, 6A to 6C) all relate to the apparatus construction (see FIG. 1) wherein the second image exposing process 6 is carried out immediately after the second developing unit 5. However, the present invention can likewise be adapted to the construction wherein the second image exposing process is carried out immediately after the first developing unit 4 or the third developing unit 7.

Figure 9:
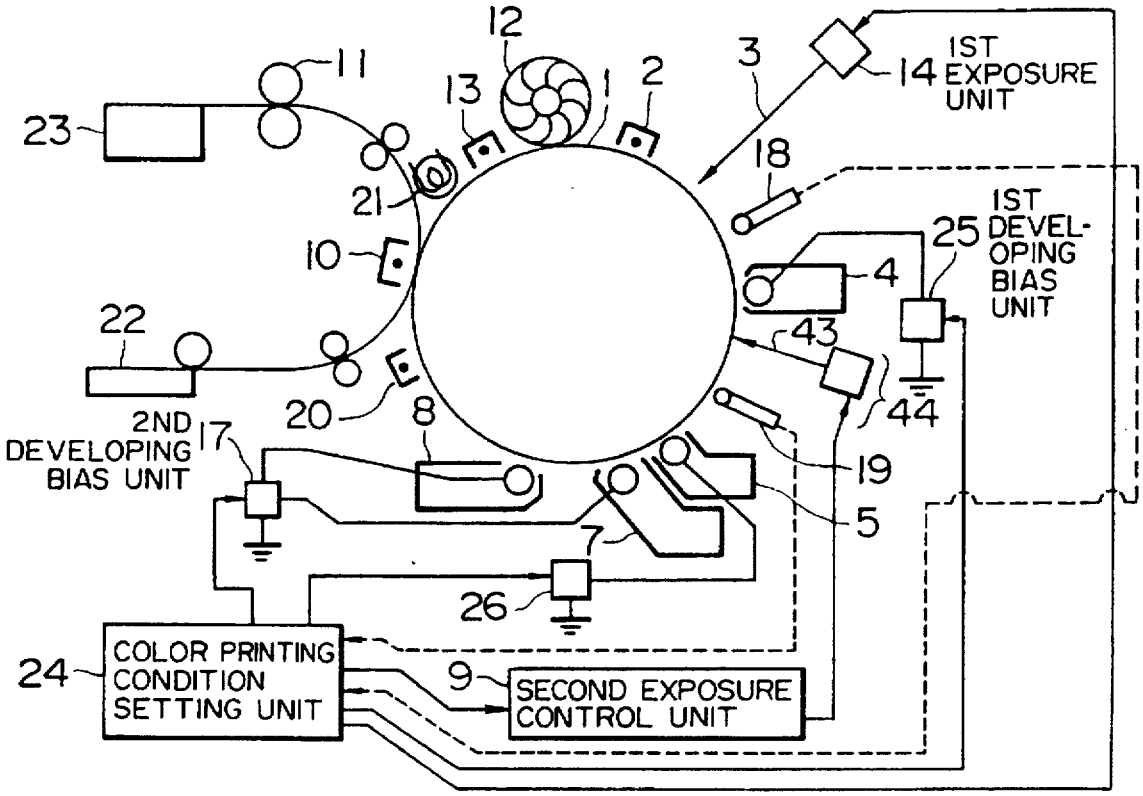
FIG. 9 is a schematic view showing an image formation apparatus according to still another embodiment of the present invention.
Figure 10:
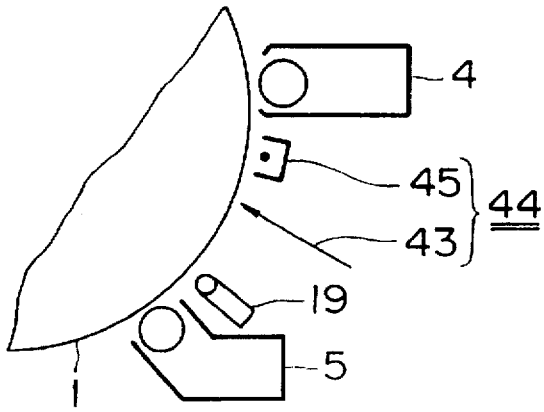
FIG. 10 is a schematic view showing a part of the image formation apparatus according to the embodiment of the present invention shown in FIG. 9.
Figure 11A:
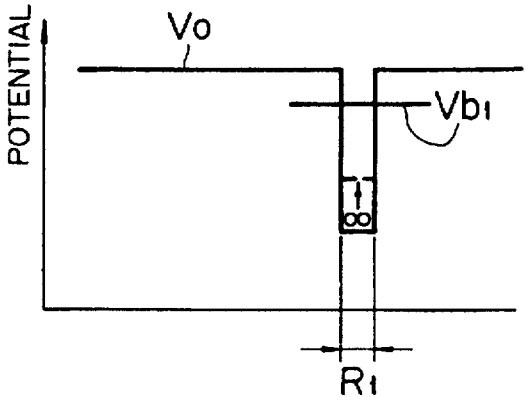
FIGS. 11A, 11B, 11C and 11D are diagrams each showing a distribution of a surface potential in an image formation method according to the embodiment of the present invention shown in FIG. 9.
Figure 11B:
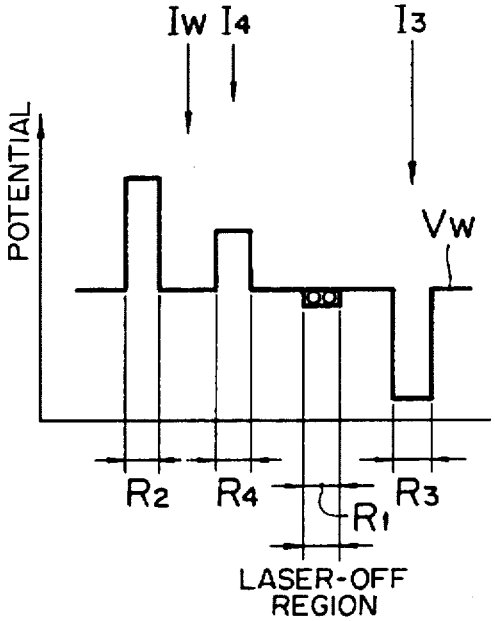
Figure 11C:
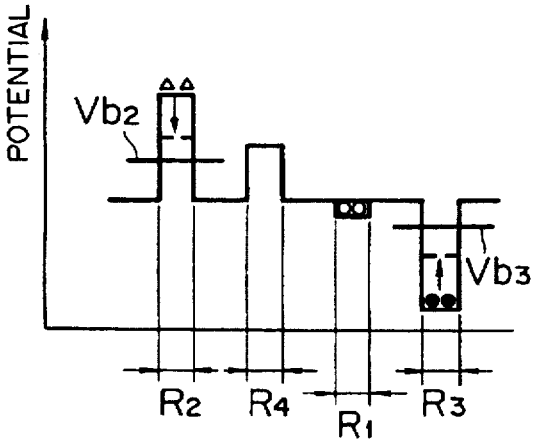
Figure 11D:
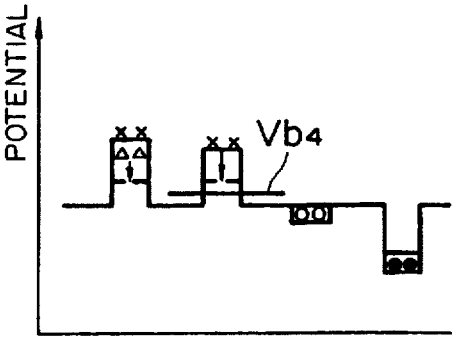
Figure 12A:
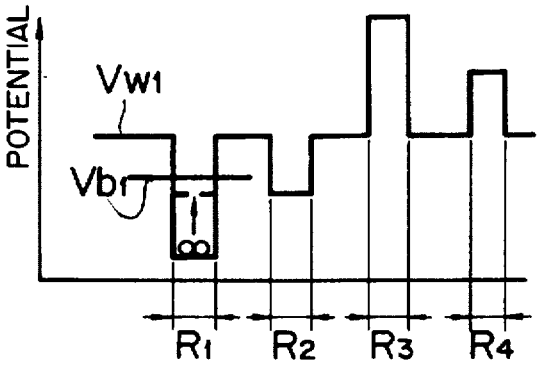
FIGS. 12A, 12B, 12C and 12D are diagrams each showing a distribution of a surface potential in the image formation method according to another embodiment of the present invention.
Figure 12B:
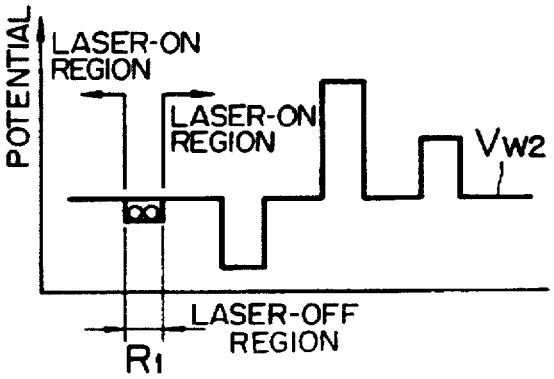
Figure 12C:
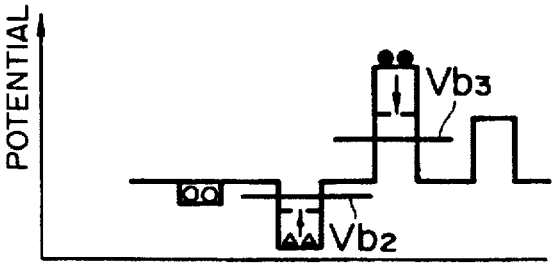
Figure 12D:
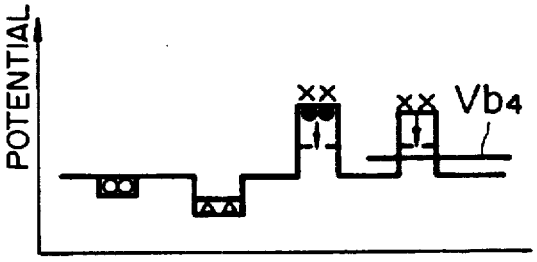

FIGS. 9 and 10 show a structural example of the apparatus wherein the second exposure 43 is disposed immediately after the first developing unit 4. FIGS. 11A to 11D and 12A to 12D are potential distribution diagrams in this case. In FIGS. 11A to 11D, the first latent image of the second levels is formed in the region $R_1$ by the first exposure 3 and is developed by the first color developing unit 4. Then, the background area, the third latent image area ($R_3$) and the fourth latent image area ($R_4$) are exposed by the second exposure 43 with mutually different light intensities of $I_w$, $I_3$ and $I_4$, respectively, so as to form a four-level image. Thereafter, second to fourth developments are carried out to form a four-color toner image.

In this embodiment, the fourth color toner is likely to mix in the second color toner image area to cause color mixture. Therefore, when a full color image is formed, the second and fourth colors are preferably black and yellow, respectively. When a multi-color image is formed, too, the color series must be decided in consideration of color mixture into the second color toner image area. In other words, it is preferred to use a color having low lightness for the second color toner and a color having high lightness for the fourth color toner. For this reason, the construction and arrangement of each color are limited, but this embodiment provides the advantage that the first color toner need not have the property of transmitting the light for the second image exposing process because exposure is not effected from above the first color toner image.

FIGS. 12A to 12D show the process comprising forming the five-level image by the first exposure 3, effecting inverse development of the region $R_1$ by the first color toner, irradiating the regions (background area and regions $R_2$ to $R_4$) other than the first color toner image area by the second exposure 43 at an equal light intensity, shifting the potential level so that the potential of the first color toner image area is substantially equal to the potential of the background area, and then carrying out second to fourth developments. In this embodiment, too, the fourth color toner is likely to mix into the third color toner image area. Therefore, the third and fourth colors are preferably black and yellow, respectively, when a full color image is formed. Since the first color toner image region ($R_1$) is not exposed by the second exposure as in the embodiment shown in FIGS. 11A to 11D, there is the advantage that the first color toner need not have the property of transmitting the light for the second exposure. This embodiment provides another advantage that the second exposure can be simplified, though the first exposure becomes somewhat complicated.

When the potential of the first toner image area is not sufficiently high in the embodiments shown in FIGS. 11A to 11D and 12A to 12D, re-charging unit 45 may be disposed at a pre-stage of the second exposure 43 so as to raise the potential, as shown in FIG. 10.

Figure 13:
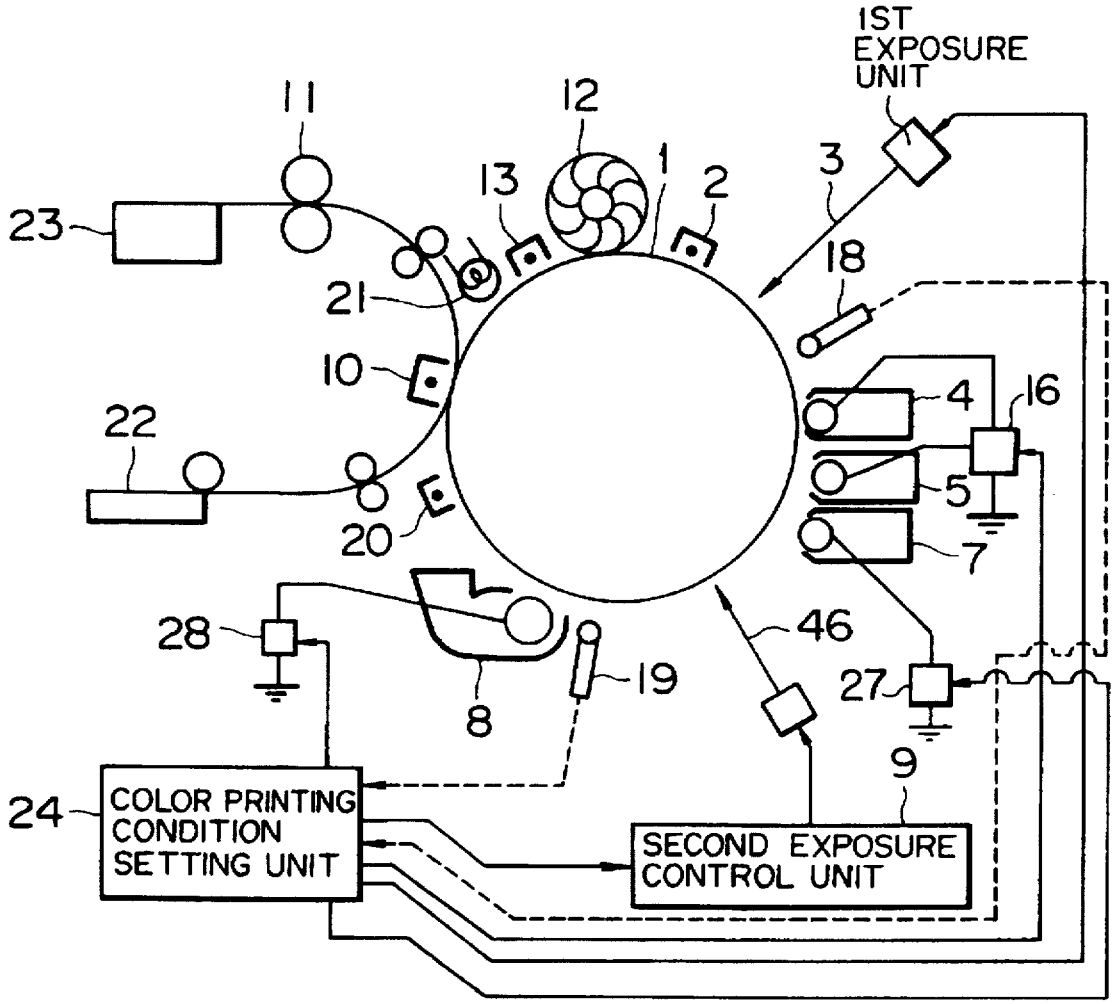
FIG. 13 is a schematic view showing an image formation apparatus according to another embodiment of the present invention.
Figure 14A:
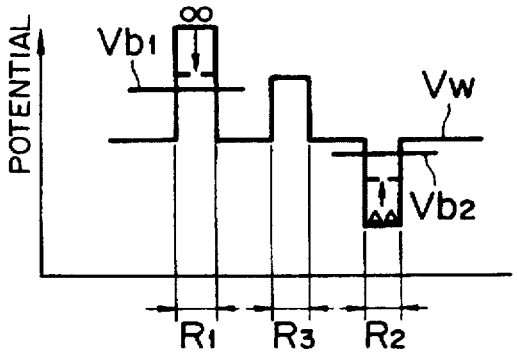
FIGS. 14A, 14B, 14C and 14D are diagrams each showing a surface potential in the image formation method according to another embodiment of the present invention.
Figure 14B:
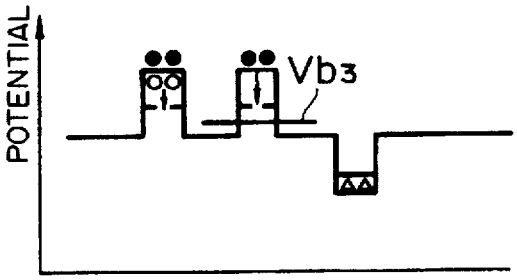
Figure 14C:
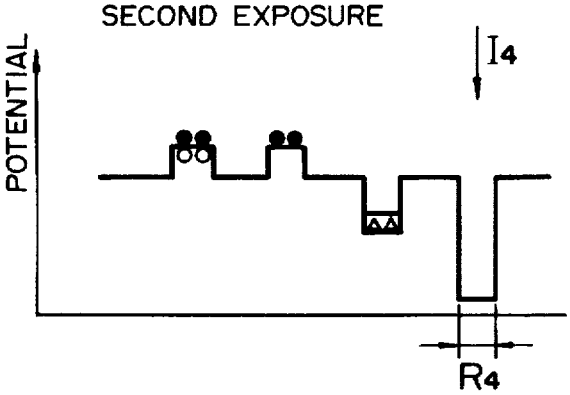
Figure 14D:
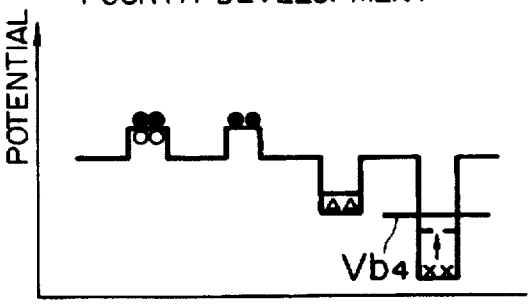

FIG. 13 shows a structural example of the apparatus wherein the second exposure 46 is disposed immediately downstream of the third developing unit 6, and FIGS. 14A to 14D are potential distribution diagrams in this case.

FIGS. 14A to 14D show a process comprising forming a four-level image by the first exposure, effecting normal development of the high potential region ($R_1$) by first/second development, effecting inverse development of the low potential region ($R_2$), and then carrying out third development. When only the fourth latent image region ($R_4$) is exposed by the second exposure, inverse development becomes possible by fourth development. In this embodiment, too, the third color toner is likely to mix into the first color toner image area, but there is the advantage that the first color toner need not have the property of transmitting the light for the second exposure By the way, when a full color image is formed, the first and third colors are preferably black and yellow, respectively.

Still another embodiment of the present invention will be explained with reference to FIGS. 15, 16 and 17A to 17D.

Figure 15:
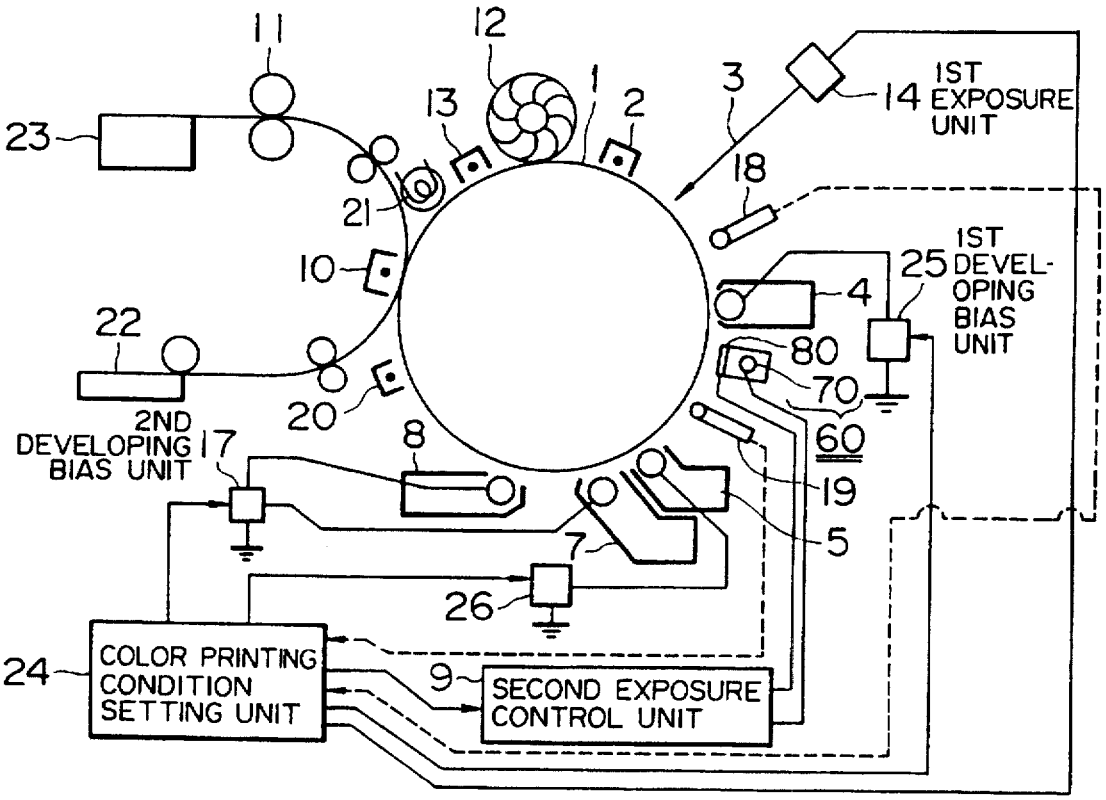
FIG. 15 is a schematic view showing an image formation apparatus according to still another embodiment of the present invention.
Figure 16:
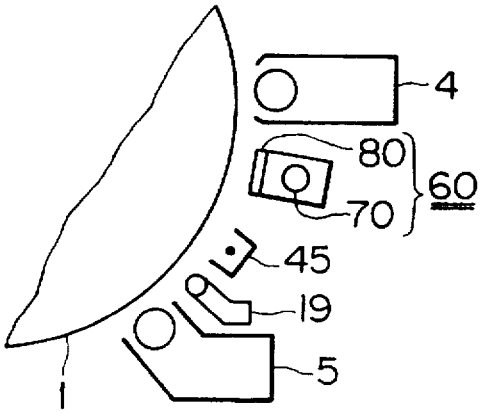
FIG. 16 is a schematic view showing a part of the image formation apparatus according to the embodiment of the present invention shown in FIG. 15.

FIGS. 15 and 16 show a structural example of the image formation apparatus according to still another embodiment of the present invention. Charging 2, exposure 3, first developing unit 4, second developing unit 5, third developing unit 7, fourth developing unit 8, a light irradiation unit 60 made up of a lamp 70 and a filter 80, pre-transfer charging unit 20, transferring unit 10, fixing unit 11, a cleaner 12, charge elimination corona lamp 21, 13 are disposed around a photosensitive body 1. There are further disposed surface potentiometers 18, 19 and second exposure control unit 9 for controlling the light irradiation unit. The first to fourth colors are cyan, magenta, black and yellow, respectively. The wavelength of irradiation light from the light irradiation unit 60 is regulated so that it can be absorbed by the first color (cyan) toner. Four color toner images are formed on the photosensitive body 1 by the following method.

FIGS. 17A to 17D are corresponding surface potential diagrams, and the explanation will be given with reference to these diagrams.

① First of all, charge images of five levels are formed by charging and exposure. They correspond to the first charge image (region $R_1$), the second charge image (region $R_2$), the background area (region having a potential $Vw_1$), of the fourth charge image (region $R_4$) and the third charge image (region $R_3$) from the lower level, respectively.

Figure 17A:
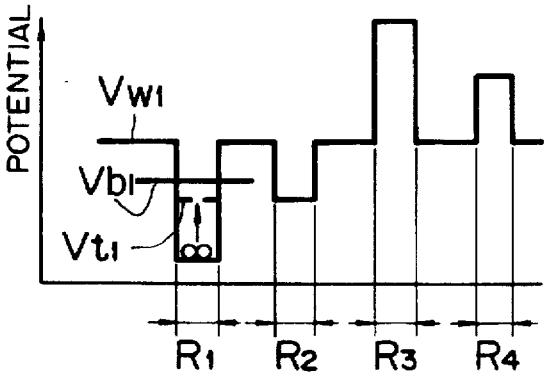
FIGS. 17A, 17B, 17C and 17D are diagrams each showing a distribution of a surface potential in the image formation method according to the embodiment of the present invention shown in FIG. 15.

② The first charge image (region $R_1$) having greater electrostatic contrast (charge extinction degree) among the first and second charge images is subjected to inverse development by the first developing unit 4 and the first color toner (for example, cyan toner) is caused to adhere (FIG. 17A).

In order to prevent color mixture into the first color toner image in second development, the potential $Vt_1$ of the first color toner image area is preferably raised to a high potential. To regulate the potential of the first color toner image area, the toner used preferably has a mean particle size of 15 to 25 μm and a large charge quantity (absolute value) of from about 30 to about 60 μc/g. Besides the method described above, it is possible to employ a method which reduces the specific dielectric constant of the first toner (e.g. 1.5 to 2.0) so as to reduce the electrostatic capacity of the toner, and a method which disposes a light irradiation unit and re-charging unit 45 immediately after the first developing process so as to re-charge the toner.

Figure 17B:
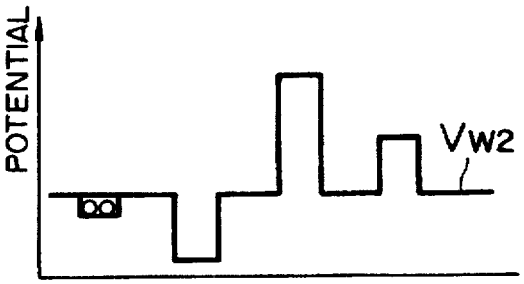

③ Light of the lamp 70 is irradiated through the filter 80 by the light irradiation unit 60 with the built-in lamp 70 and filter 80, the surface potentiometers 18, 19 and the second exposure control unit 9 for controlling the light irradiation unit to damp the charge potential of the photosensitive body, and light of a wavelength region absorbed by the first color toner is irradiated (FIG. 17B).

When the first color toner is cyan, magenta or yellow, for example, light of red, green or blue is irradiated. When the first color toner is black, light having an arbitrary wavelength region and sensitivity to the photosensitive body may be irradiated. When the first color is a color (saturated color) and the kind of the first color toner is switched, the wavelength of light irradiated from the light irradiation unit 60 is adjusted to that this light can be absorbed by the first color toner image by (1) a method which switches a lamp 70 having a plurality of different light emission wavelengths, (2) a method which switches a filter having a plurality of different transmission wavelength characteristics, or (3) a method which uses a color light emission device such as a liquid crystal, an LED or a gas discharge system.

As a result, the potentials of the regions $R_2$, $R_3$, $R_4$, to which the toner does not adhere, and the potential of the background area, among the latent image potentials on the photosensitive body drop, but the potential $Vt_1$ of the first color toner image area after the irradiation of light can be maintained in the region $R_1$ in which the first color toner image is formed. Further, the potential $Vt_1$ of the first color toner image area is set to be a little higher than the second developing bias potential $Vb_2$ by using the re-charging unit 45 in combination, whenever necessary.

④ Inverse development of the second charge image is effected by the second developing unit 5 and the second color toner (for example, magenta) is caused to adhere, thereby forming the second color toner image.

Figure 17C:
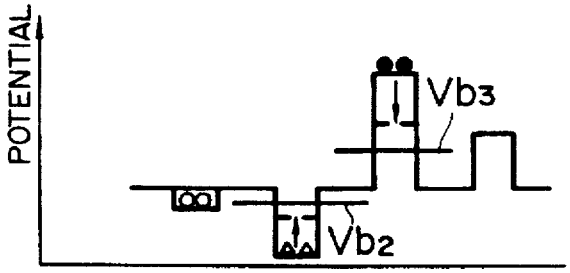

⑤ Normal development of the third charge image (region $R_3$) is carried out by the third developing unit 7 and the third color toner (for example, black) is caused to adhere, thereby forming the third color toner image. The third color toner has an opposite polarity to that of the first and second toners, but the third color toner does not adhere to other image areas because (1) the third developing bias potential $Vb_3$ is higher than the first and second color toner image potentials $Vt_1$, $Vt_2$, and because (2) this potential $Vb_3$ is higher than the potential of the fourth charge image (region $R_4$: FIG. 17C).

Figure 17D:
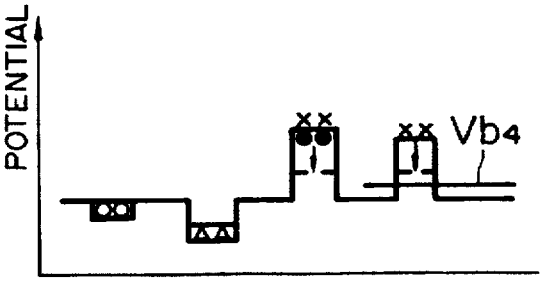

⑥ Normal development of the fourth charge image (region $R_4$) is carried out by the fourth developing unit 8 and the fourth color toner (for example, yellow) is caused to adhere, thereby forming the fourth color toner image (FIG. 17D). Though the fourth color toner has an opposite polarity to that of the first and second color toners, it does not adhere to the first and second color toner image areas because the fourth developing bias potential $Vb_4$ is higher than the image potentials of the first and second color toner images. However, since the fourth developing bias potential $Vb_4$ is lower than the third color toner image potential, the fourth color toner adheres to the third color toner image area (region $R_3$). Because the fourth color toner mixes into the third color toner image area, the color kind of the third color toner is preferably black or a color having low lightness, whereas the color kind of the fourth color toner is preferably yellow or a color toner having high lightness. Particularly when yellow is used for the fourth color toner, the color kind of the third color toner is preferably a toner containing a pigment prepared by mixing cyan and magenta.

⑦ The four-color toner image is formed on the photosensitive body by the process steps ① to ⑥ described above.

⑧ Polarities of the four-color toner images are made uniform by the pre-transfer charging unit 20 for generating AC+DC corona, and the images are transferred to the sheet by the transferring unit 10.

⑨ The four-color toner image is thermally fused and fixed to the sheet by the fixing unit 11.

The explanation will be supplemented on the surface potential regulation step which is effected at the pre-stage of second development. The surface potentiometers 18, 19 are disposed immediately before the first and second developing units 4, 5, respectively, and the light quantity of the lamp 70 and the filter 80 are controlled on the basis of the detection signals of these surface potentiometers 18, 19. The detection signals of the surface potentials are stored in the memory unit of the color printing condition setting unit 24. The light irradiation condition is set on the basis of the detection values of the surface potentials and is transmitted to the second exposure control unit 9. The first and second developing biases are set and are transmitted to the first and second developing bias units 25, 26. The surface potentiometer 18 monitors the initial charge potential and controls the charging unit 2 through the color printing condition setting unit 24 in such a manner as to attain a predetermined potential. The surface potentiometer 19 monitors the potential $Vt_1$ of the first color toner image area after the irradiation of light and the potential $Vw_2$ of the background area, and controls the second exposure control unit 9 through the color printing condition setting unit 24 so as to attain a predetermined potential difference between the potential $Vt_1$ and the potential $Vw_2$ of the background area.

In the construction described above, the light irradiation unit for regulating the surface potential (potential of the toner image and the latent image) is disposed upstream of the second developing unit repeating inverse development so as to regulate the surface potential immediately before the second development. Because the second developing bias can thus be set to be somewhat lower than the potential of the first color toner image, color mixture does not occur at the time of second development.

During third development, the toner having a different polarity from that of the toner of first and second developments is used and normal development is effected by applying a developing bias higher than the toner image potential formed at the preceding stages. Accordingly, color mixture does not occur in the first and second color toner images, and because the developing bias is higher than the potential of the fourth charge image, the third color toner does not mix in the fourth color image area.

The fourth color toner mixes into the third color toner image during fourth development. However, since the color kind of the third color toner can be set in advance in consideration of color mixture so that the third color toner image expresses black, turbidity of the color can be mitigated. In other words, the first, second and fourth color toner images can represent the monochromatic images of yellow, magenta and cyan free from color mixture, while the third color toner image can represent black by the mixed color image. Since the full color image can be formed by the combination of these colors, this embodiment provides the advantage that clear full color printing can be made by one shot.

Figure 18:
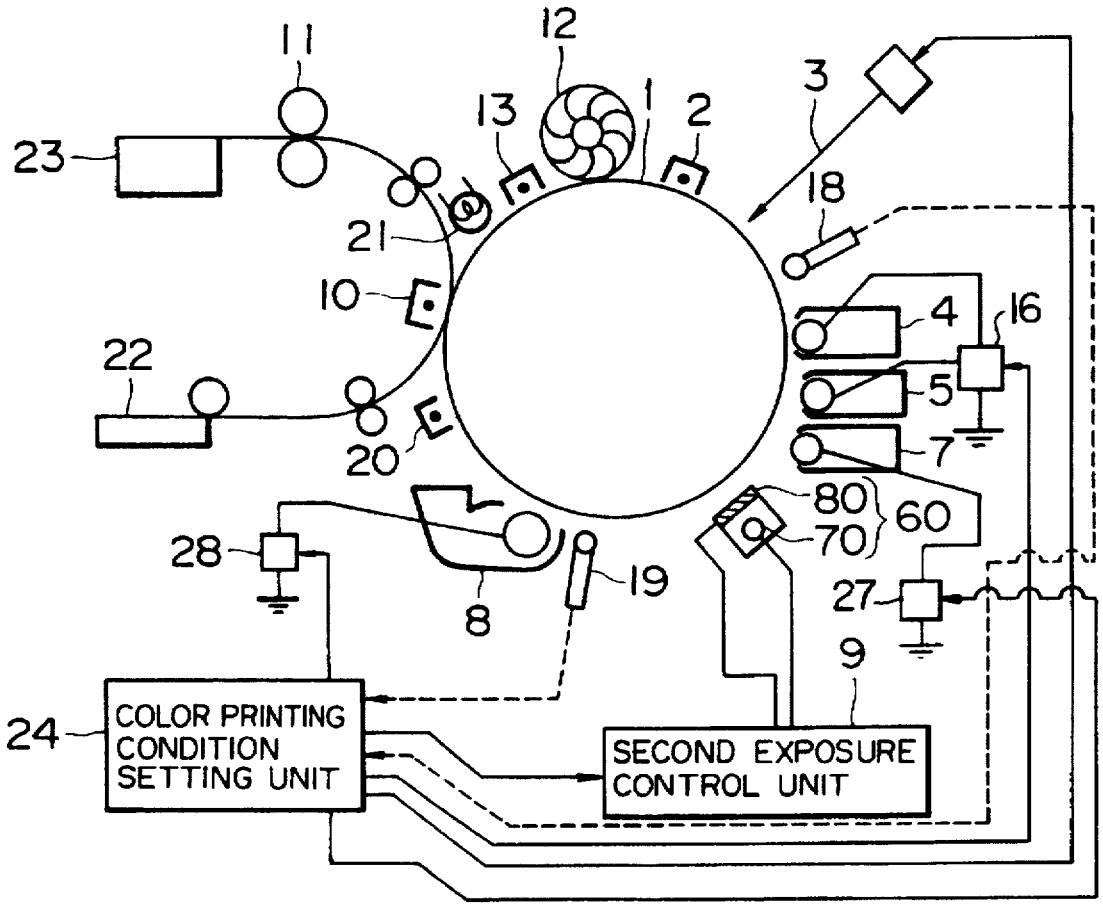
FIG. 18 is a schematic view showing an image formation apparatus according to still another embodiment of the present invention.
Figure 19A:
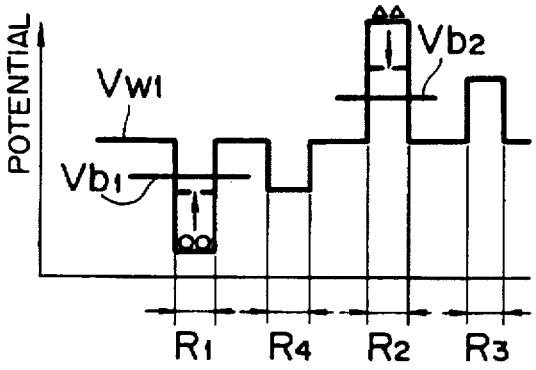
FIGS. 19A, 19B, 19C and 19D are diagrams each showing a distribution of a surface potential in the image formation method according to the embodiment of the present invention shown in FIG. 18.
Figure 19B:
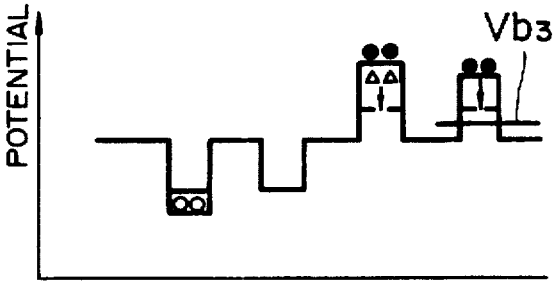
Figure 19C:
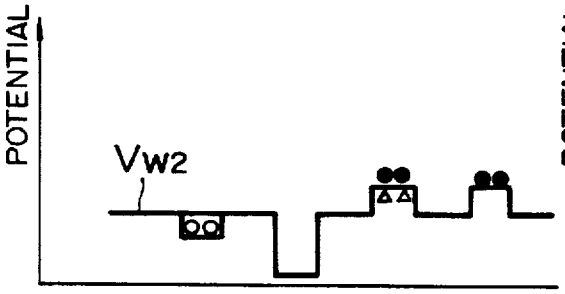
Figure 19D:
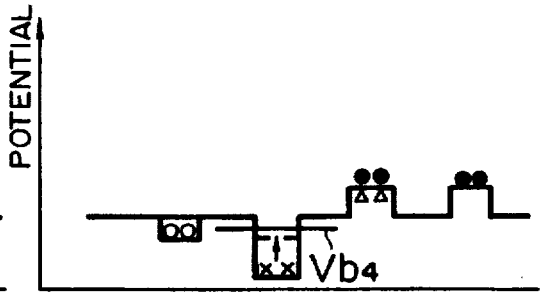

FIG. 18 shows still another embodiment of the present invention. In this embodiment, the light irradiation unit 60 is disposed downstream of the third developing unit 7 and the second inverse development process is carried out by the fourth developing unit 8.

FIGS. 19A to 19D are the surface potential distribution diagrams of the photosensitive body in this embodiment. In this embodiment, too, the first color toner preferably has a color capable of absorbing light irradiated from the light irradiation unit 60. However, since the third color toner mixes into the second color image area in this embodiment, it is possible to use black or a color having low lightness for the second color toner and to use yellow or a color having high lightness for the third color toner. For example, it is possible to use green type light from the light irradiation unit, and to use magenta, black, yellow and cyan for the first, second, third and fourth colors, respectively.

According to this embodiment, the difference between the developing bias of normal development (second developing unit 5 and third developing unit 7 in FIG. 18) and the potential of the inverse development toner image (the first color toner image) can be made greater than that in the embodiment shown in FIG. 15. Accordingly, the degree of color mixture into the inverse development toner image at the time of normal development can be further reduced.

Full color printing can be made while the photosensitive body 1 rotates two rotations by executing the processes up to the third developing unit 7 before the photosensitive body 1 rotates one rotation, using the charge elimination lamp 21 or the charge elimination corona unit 13 in place of the light irradiation unit 60 (effecting re-charging by the use of the charging unit 2 when re-charging is further necessary), using the surface potentiometer 18 also as the surface potentiometer 19 and effecting fourth development during the second rotation of the photosensitive body 1. Although the printing speed drops to ½, the light irradiation unit 60 and the surface potentiometer 19 can be eliminated, so that the image formation apparatus can be made more compact as a whole.

Furthermore, it is possible to employ the process which comprises forming the five-level charge image on the photosensitive body, disposing a plurality of developing units using toners of the same polarity, providing potential regulation steps for regulating the potential of a toner image on a charge image receptor, which is obtained by inverse development of a preceding stage, on the upstream side of the inverse development steps of the second et seq., to be substantially equal to the potential of the background area, and forming the color image by inverse development using the toners of the same polarity throughout all the developments. In this case, the light irradiation unit 60 (and the re-charging unit 45, if necessary) must be disposed immediately before the second to fourth developing units, respectively, and the color image formation apparatus therefore becomes somewhat greater in size. However, since all the developments can be carried out using the toners having the same polarity, the pre-transfer charging unit 20 for making uniform the polarities of the toners can be eliminated.

Still another embodiment of the present invention will be described.

Figure 20:
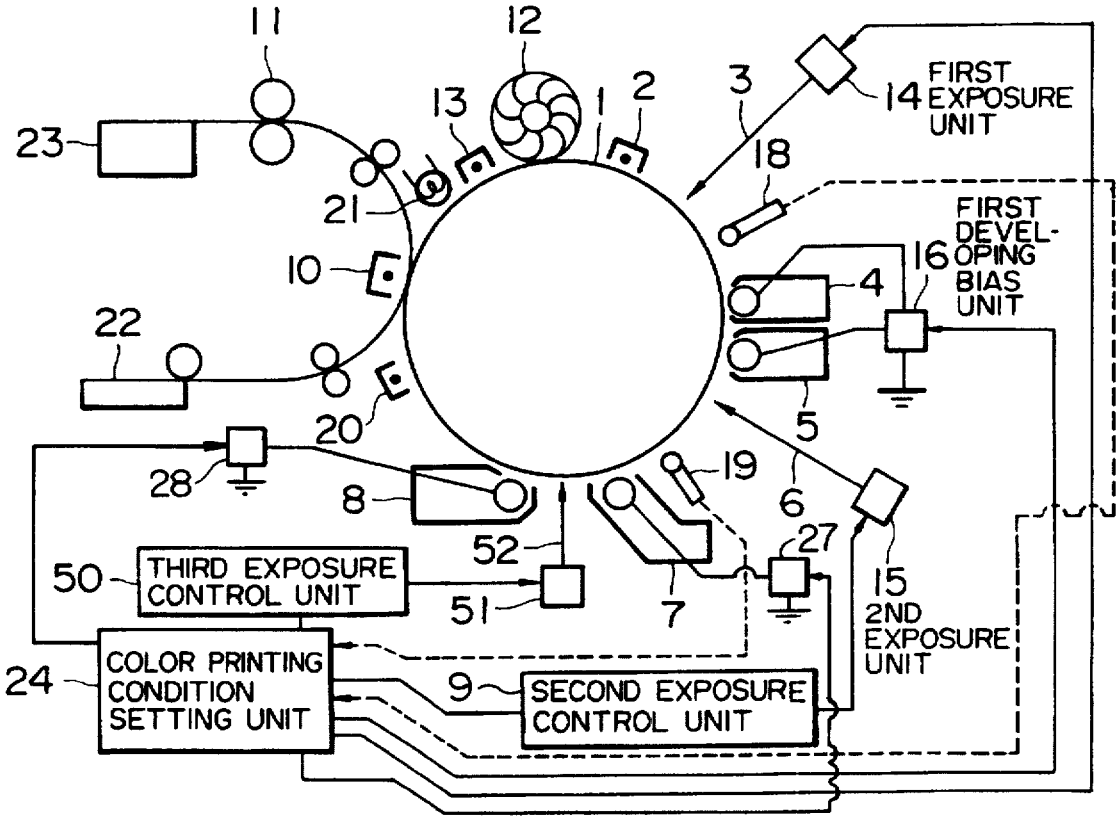
FIG. 20 is a schematic view showing a part of the image formation apparatus according to still another embodiment of the present invention.

FIG. 20 shows an example of the color image formation apparatus. In this embodiment, a third exposure control unit 50 is further disposed in order to control a third exposure, and the first to fourth colors are yellow, black, magenta and cyan, respectively, for example. Further, the second and third exposures 6, 52 can penetrate the first and third color toners, respectively, and the four-color toner image is formed on the photosensitive body 1 by the following method.

FIGS. 21A to 21E are corresponding diagrams of the surface potential distribution, and the explanation will be given with reference to these diagrams.

① First of all, after uniform charging is effected by the first charging, a four-level charge image is formed by the first image exposure 3. The four levels correspond to the first charge image (inclusive of regions $R_{134}$, $R_{14}$, $R_1$, $R_{13}$), the third charge image (regions $R_3$, $R_{34}$), the $V_w$, second charge image (region $R_2$) from a higher level, respectively.

Figure 21A:
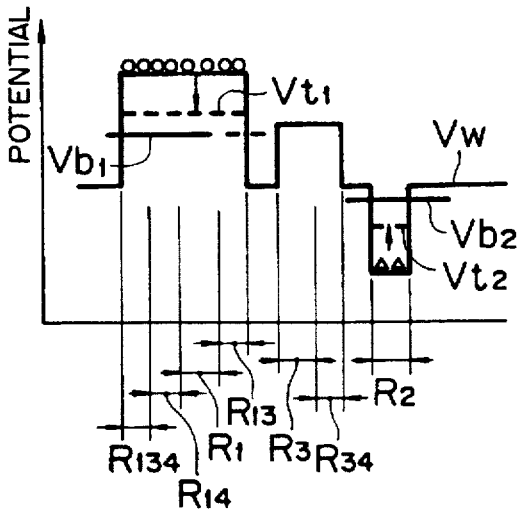
FIGS. 21A, 21B, 21C, 21D and 21E are diagrams each showing a distribution of a surface potential in the image formation method according to the embodiment of the present invention shown in FIG. 20.

② Among the charge images, the first charge image (inclusive of the region $R_1$) is subjected to normal development by applying a bias $Vb_1$ higher than the potential of the third charge image (regions $R_3$, $R_{34}$) by the first developing unit 4 as shown in FIG. 21A, and the first color toner (for example, yellow toner) is caused to adhere. Inverse development is effected for the second charge image (region $R_2$) by applying a bias $Vb_2$ lower than the potential Vw of the background area by the second developing unit 5, and the second color toner (for example, black toner) is caused to adhere.

Figure 21B:
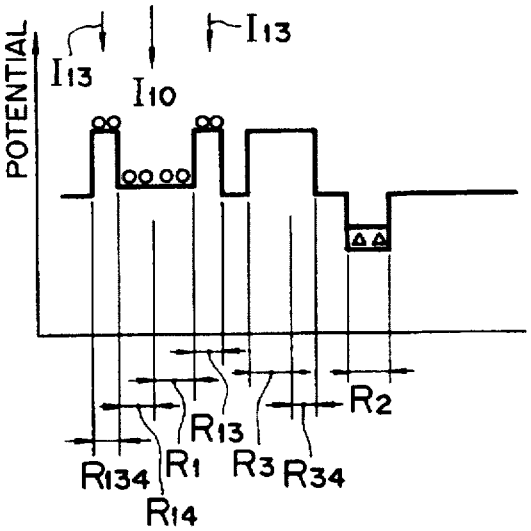

③ Next, as shown in FIG. 21B, selective exposure is effected for the first color toner image (region $R_1$) by the second exposure 6 so as to regulate the potential. In other words, light having an intensity $I_{10}$ is irradiated to the regions $R_{14}$ and $R_1$ among the first toner image area so that the potential of the regions $R_{14}$ and $R_1$ is substantially equal to the potential Vw of the background area. Light having an intensity $I_{13}$ is irradiated to the regions $R_{134}$ and $R_{13}$ so that the potential of the regions $R_{134}$ and $R_{13}$ is equal to the potential of the third charge image (regions $R_3$, $R_{34}$), thereby forming the third charge image having the first color toner image.

Figure 21C:
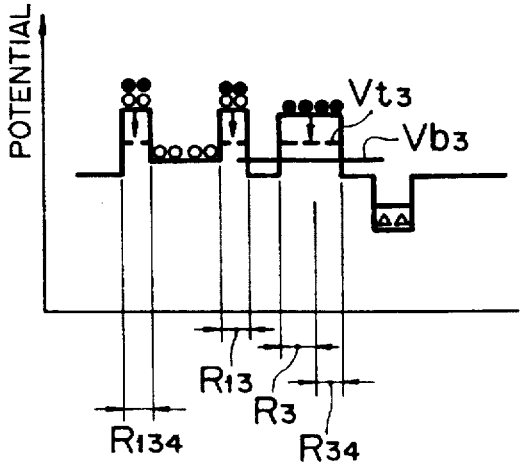

④ A bias $Vb_3$ at least equal to the potential Vw of the background area is applied to this third charge image (regions $R_3$, $R_{34}$, $R_{134}$, $R_{13}$) by the third developing unit 7 as shown in FIG. 21C to effect normal development, and the third color toner (for example, magenta toner) is caused to adhere.

Figure 21D:
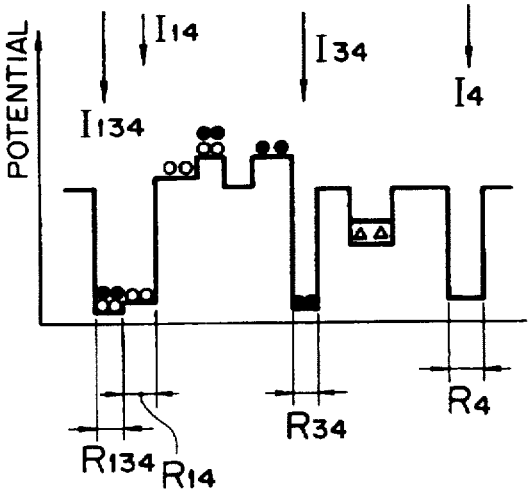

⑤ Further, selective image exposing is effected for the first and second toner image areas by the third exposure 52 to regulate the potentials as shown in FIG. 21D, and image exposing is effected in a new portion of the background area (intensity $I_4$) to form the fourth charge image. In other words, light having an intensity $I_{14}$ is irradiated to the region $R_{14}$ among the first color toner image area, light of intensity $I_{34}$ and intensity $I_{134}$ is irradiated to the regions $R_{34}$ and $R_{134}$ of the second color toner image area, respectively, and light having intensity of $I_4$ is irradiated to the region $R_4$ so that the potential of the fourth charge image (regions $R_{134}$, $R_{14}$, $R_{34}$, $R_4$) is sufficiently lower than the potential of the second color toner image area (region $R_2$).

Figure 21E:
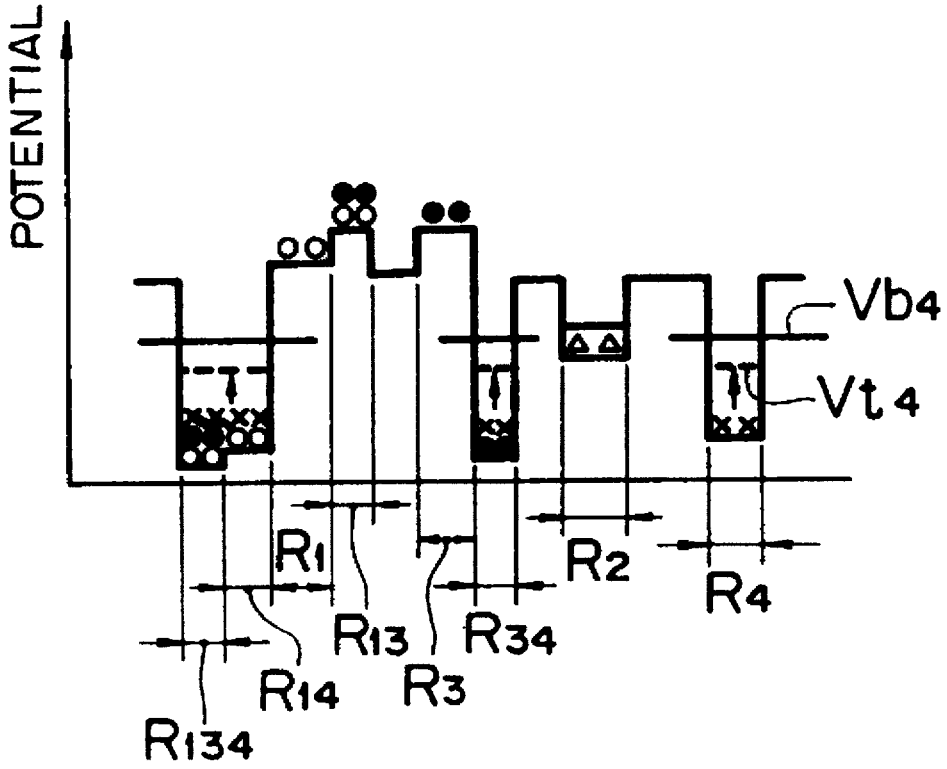

⑥ A bias $Vb_4$ lower than the potential of the second color toner image area (region $R_2$) is applied to this fourth charge image (regions $R_{134}$, $R_{14}$, $R_{34}$, $R_4$) by the fourth developing unit 8 as shown in FIG. 21E so as to effect inverse development, and the fourth color toner (for example, cyan toner) is caused to adhere.

The four color toner images are formed on the photosensitive body by the process steps ① to ⑥ described above.

⑦ Then, the polarities of the four color toner images are made uniform by the pre-transfer charging unit 20 generating AC+DC corona, and the image is then transferred to the sheet by the transferring unit 10.

⑧ The four-color toner image is thermally fused and fixed to the sheet by the fixing unit 11 to obtain full color printing.

Next, second and third image exposing will be explained supplementarily. The surface potentiometers 18, 19 are disposed immediately before the first and third developing units 4, 6, and the potential Vw of the background area and the potential of the first color toner image area (region $R_1$) after second image exposing are measured. The detection values of the surface potentials are stored in the memory unit of the color printing condition setting unit 24 in order to control the image exposing intensity and the light quantity of each of second and third image exposing on the basis of these measurement values. The control condition of second and third image exposing is set on the basis of the detection values of the surface potentials, and are transmitted to the image exposure control units 9 and 50 to control the second and third image exposure units 15, 51.

The color printing condition setting unit 24 sets the conditions of the first to fourth developing biases on the detection values of the surface potentials, transmits them to the first to third developing bias units 16, 27, and 28, monitors the initial charge potential by the surface potentiometer 18, and controls the charging unit 2 so as to attain a predetermined potential.

The tone of the color superposition image can be expressed by regulating the image exposing conditions of the first to third image exposures and the fourth developing bias.

When a color toner having high lightness is used for the third developing unit 7 in the construction shown in FIG. 20, the floating and scattering toner is likely to be built up in the third developing unit 7. Therefore, the third developing unit 7 is preferably spaced apart from the second developing unit 5 as much as possible.

In the construction described above, the second exposure for regulating the surface potential (potential of the toner image and the latent image) is disposed upstream of the third developing unit for effecting second normal development to regulate the surface potential immediately before third development, and the third developing bias $Vb_3$ can be set to be at least equal to the first color toner image potential (approximate to the background area potential) and to the second color toner image potential $Vt_2$. Accordingly, the third color toner does not adhere (color mixture does not occur in) to other image areas during third development.

During fourth development in which second inverse development is carried out, the toner having the same polarity as the toner used for second development is used, but color mixture does not occur in the second color toner image (region $R_2$) because inverse development is carried out by applying the fourth developing bias $Vb_4$ which is lower than the toner image potential $Vt_2$ formed by second development. Further, since the fourth developing bias $Vb_4$ is lower than the potentials of the first and third charge images, the fourth color toner does not mix into the first and third color image areas (regions $R_1$, $R_{13}$, $R_3$).

As described above, color superposition of the first to fourth color toner images can be made on the photosensitive body, whenever necessary, and the monochromatic image of yellow, magenta, cyan or black free from color mixture can also be formed. In other words, it is possible to form the color superposition image of yellow, magenta and cyan in the region $R_{134}$, the color superposition image of yellow and cyan in the region $R_{14}$, the color superposition image of yellow and cyan in the region $R_{13}$, the color superposition image of magenta and cyan in the region $R_{34}$, the monochromatic image of yellow in the region $R_1$, the monochromatic image of black in the region $R_2$, the monochromatic image of magenta in the region $R_3$ and the monochromatic image of cyan in the region $R_4$.

Further, varicolored tones can be expressed in each of the color superposition images by controlling each developing bias and each image exposing condition.

Accordingly, the present invention provides the effect that clear full color printing can be made in one path.

In the embodiment shown in FIGS. 20 and 21A to 21E, the normal development system is used for first and third development and the inverse development system for second and fourth development. However, it is also possible to exchange the development systems of the first and second development and to use the normal development system for second and third development and the inverse development system for first and fourth development.

Furthermore, the service life of the photosensitive body can be extended and power saving can be achieved by (1) stopping the operation of the potential regulation steps during monochromatic printing, (2) changing the charge quantity between monochromatic printing and multi-color printing and (3) making the developing bias at the time of monochromatic printing different from the developing bias at the time of multi-color printing.

When a one-component developer is used as the developer for the second development step, adhesion of the carrier to the first charge image (region $R_1$) and the third charge image (regions $R_3$, $R_{34}$) each having a high potential, which is likely to occur when a two-component developer is used, can be avoided.

When the toner scattering from the first and second developing units 4, 5 tends to adhere to the third developing unit 7 in the construction shown in FIG. 1, a color toner having low lightness (for example, cyan or black) is preferably used as the third color toner.

Figure 22:
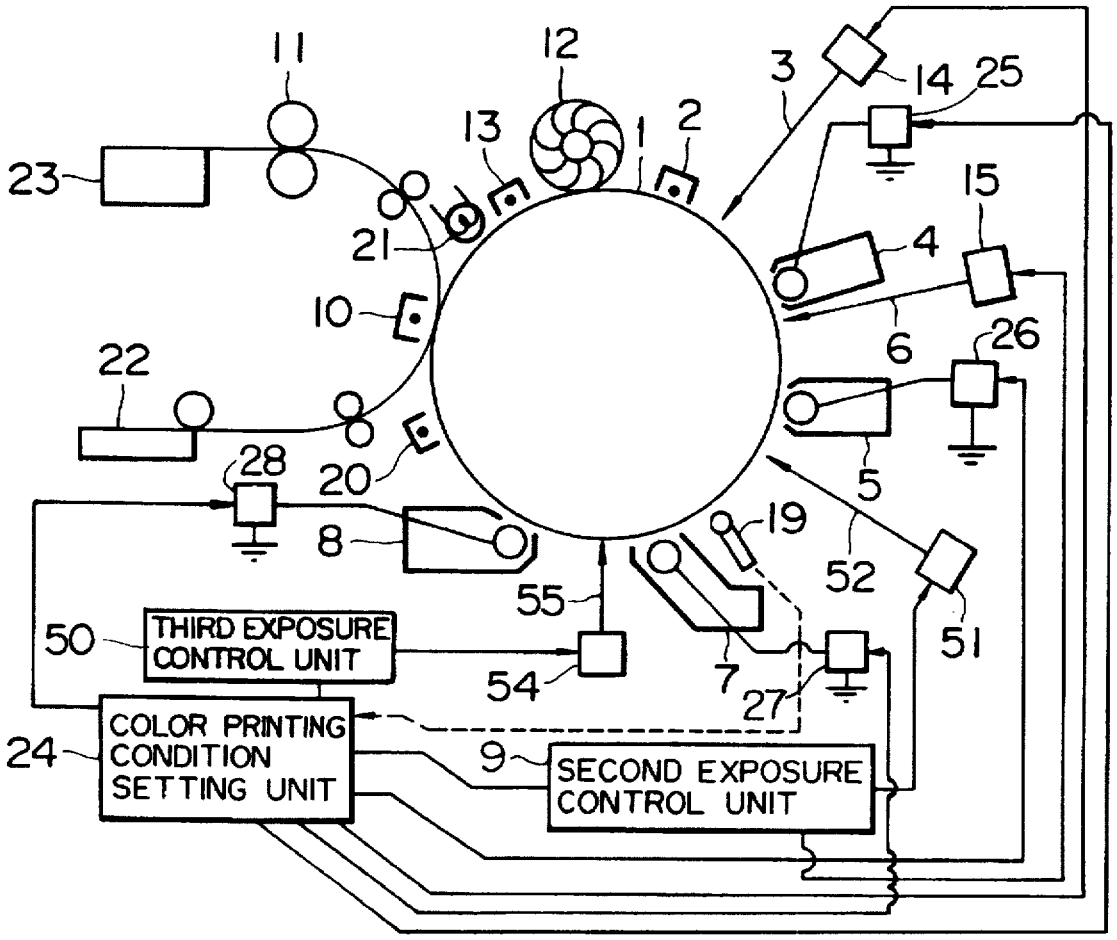
FIG. 22 is a schematic view showing an image formation apparatus according to still another embodiment of the present invention.

FIG. 22 shows still another embodiment of the present invention. The difference of this embodiment from the embodiment shown in FIG. 1 resides in that first to fourth exposures 3, 6, 52 and 55 are provided. FIGS. 23A to 23D are surface potential distribution diagrams corresponding to FIG. 22, and the explanation will be given with reference to these drawings.

Figure 23A:
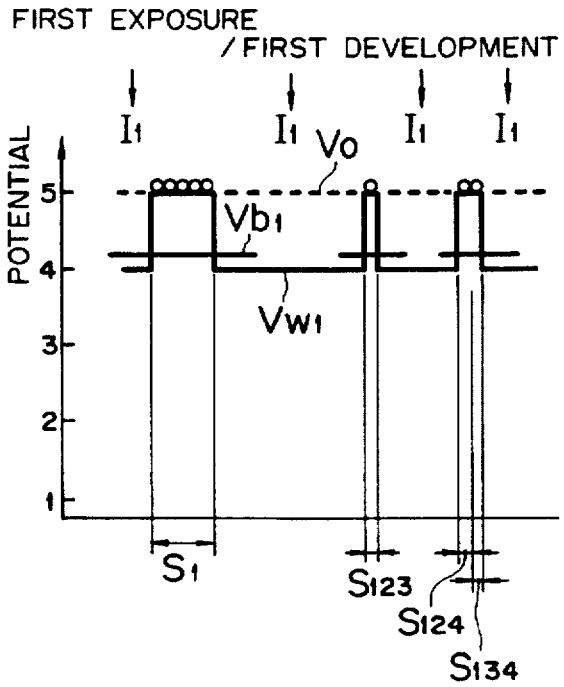
FIGS. 23A, 23B, 23C and 23D are diagrams each showing a distribution of a surface potential in the image formation method according to the embodiment of the present invention shown in FIG. 22.

(a) First image exposing/first development (see FIG. 23A)

The potential of the background area (non-image area) is lowered to $Vw_1$ by first exposure 3 (exposing intensity $I^1$), the developing bias $Vb_1$ is applied to the first charge image areas (regions $S_1$, $S_{123}$, $S_{134}$) having the first surface potential Vo by the first developing unit 4 so as to effect normal development, and the first color toner is caused to adhere.

Figure 23B:
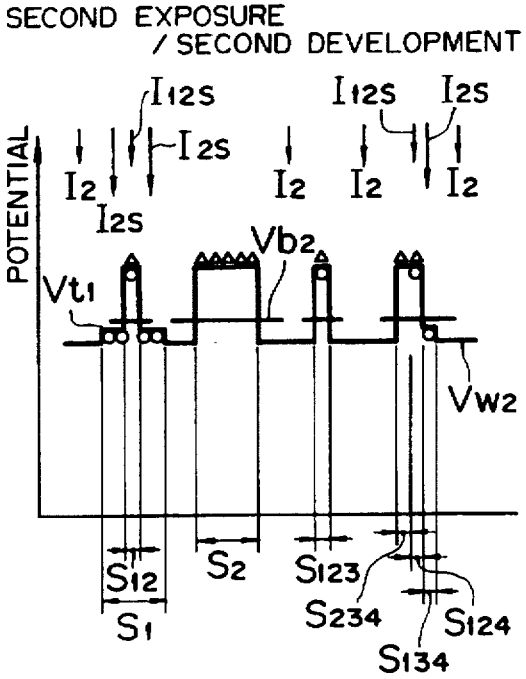

(b) Second image exposing/second development (see FIG. 23B)

The potential of the background area (non-image portion) is lowered to $Vw_2$ by the second exposure 6 (exposing intensity $I_2$, $I_2$s, $I_{12}$s), the developing bias $Vb_2$ is applied to the second charge image areas (regions $S_{12}$, $S_2$, $S_{123}$, $S_{234}$) by the second developing unit 5 so as to effect normal development, and the second color toner is caused to adhere. Image exposing $I_2$s, $I_{12}$s with the suffix "s" in second exposure 6 represents selective image exposing to the first color toner image area.

Figure 23C:
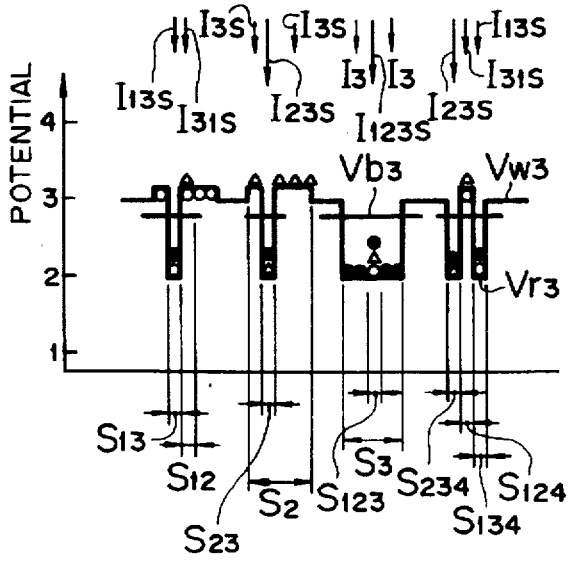

(c) Third image exposing/third development (see FIG. 23C)

The potential of the background area (non-image portion) is regulated to $Vw_3$ (approximate to $Vw_2$) by the third exposure 52 (exposing intensity $I_{13}$s, $I_{31}$s, $I_3$s, $I_{23}$s, $I_3$, $I_{123}$s), and the surface potential of the third charge image area (regions $S_{13}$, $S_{23}$, $S_3$, $S_{234}$, $S_{134}$) is lowered to $Vr_3$. The developing bias $Vb_3$ is applied by the third developing unit 7 so as to effect inverse development, and the third color toner is caused to adhere. Image exposing $I_{13}$s, $I_{31}$s, $I_3$s, $I_{23}$s, $I_{123}$s with the suffix "s" in third exposure 52 represents selective image exposing to the first or second color toner area.

Figure 23D:
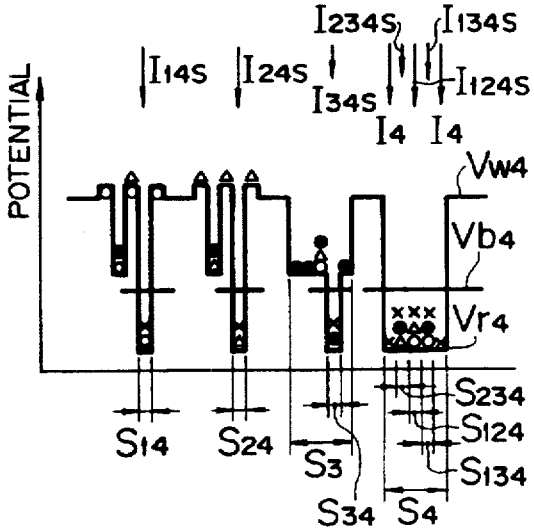

(d) Fourth image exposing/fourth development (see FIG. 23D)

The potential of the background area (non-image area) is kept at $Vw_4$ (approximate to $Vw_3$) by the fourth exposure 55 (exposing intensity $I_{14}$s, $I_{24}$s, $I_{34}$s, $I_{234}$s, $I_4$, $I_{124}$s, $I_{134}$s) and the surface potential of the fourth charge image area (region $S_{12}$, $S_{23}$, $S_3$, $S_{234}$, $S_{134}$) is lowered to $Vr_4$. The developing bias $Vb_4$ is applied by the fourth developing unit 8 so as to effect inverse development, and the fourth color toner is caused to adhere. Image exposing $I_{14}$s, $I_{24}$s, $I_{34}$s, $I_{234}$s, $I_{124}$s, $I_{134}$s with the suffix "s" in fourth exposure 55 represents selective image exposing to the first, second or third color toner image area.

According to the construction, a color superposition image of the four colors and a monochromatic image of each of the four colors can be formed by the process described above. In other words, when the first to fourth colors are yellow, magenta, cyan and black, respectively, for example, it is possible to form the color superposition image of yellow and magenta in the region $S_{12}$, the color superposition image of yellow and cyan in the region $S_{13}$, the color superposition image of yellow and black in the region $S_{14}$, the color superposition image of magenta and cyan in the region $S_{23}$, the color superposition image of magenta and black in the region $S_{24}$, the color superposition image of cyan and black in the region $S_{34}$, the color superposition image of yellow, Magenta and cyan in the region $S_{123}$, the color superposition image of yellow, cyan and black in the region $S_{134}$, and the color superposition image of magenta, cyan and black in the region $S_{234}$, and also to form the monochromatic image of yellow at a part of the region $S_1$, the monochromatic image of magenta at a part of the region $S_2$, the monochromatic image of cyan at a part of the region $S_3$ and the monochromatic image of black at a part of the region $S_4$.

Varicolored tones can be expressed in each of these color superposition images by controlling each developing bias and each image exposing condition.

Accordingly, the present invention not only provides the effect that clear full color printing can be made by one path, but also the advantage in that color superposition of yellow, magenta, cyan and black becomes possible, though the process becomes more complicated than the construction shown in FIGS. 20 and 21A to 21E due to the disposition of the fourth image exposure.

Note that although the normal development system is used for first and third development and the inverse development system for second and fourth development in the embodiment shown in FIGS. 21A to 21E, it is also possible to employ the following systems.

(a) The development system is exchanged between first and second development, the normal development system is employed for second and third development and the inverse development system for first and fourth development.

(b) The inverse development system is used for all of first to fourth development.

(c) The normal development system is used for all of first to fourth development.

(d) The normal development system is used for three of first to fourth development, and the inverse development system for the other.

(e) The inverse development system is used for three of first to fourth development, and the normal development system for the other.

Though the embodiment given above has been explained about the system (one-path full color printing system) in which the color image is formed while the photosensitive body rotates once, the present invention can of course be applied to the system (multi-path full color printing system) in which the color image is formed while the photosensitive body rotates twice. Hereinafter, another embodiment wherein the color image is formed while the photosensitive body rotates twice (two-path color printing system) will be explained with reference to FIG. 20. The surface potential distribution and the image formation process are the same as those which have been explained already with reference to FIGS. 21A to 21E. The difference of this embodiment from the embodiment shown in FIG. 20 lies in the following three points (1) to (3).

(1) One image exposure 6 functions as both the second and third image exposures 6 and 52.

(2) During the first rotation of the photosensitive body 1, the charging unit 2, the first exposure 3, the first developing unit 4, the second developing unit 5, the second exposure 6 and the third developing unit 7 are operated, and the first to third color toner images are formed on the photosensitive body 1. In this instance, the fourth developing unit 8, the pre-transfer charging unit 20, the transferring unit 10, the charge elimination lamp 21, the charge elimination corona unit 13 and the cleaner 12 are kept inactive and out of contact from the photosensitive body 1. The sheet is not transferred to the transfer unit, either, and is kept out of contact from the photosensitive body 1, so that the toner images on the photosensitive body 1 are not scraped or disturbed.

(3) During the second rotation of the photosensitive body 1, the image exposure 6 which functions also as the third exposure 52 and the fourth developing unit 8 operate, and the fourth color toner image is formed on the photosensitive body 1 retaining thereon the first to third color toner images. Thereafter, the polarities of the four color toner images are made uniform by the pre-transfer charging unit 20, and the image is transferred to the sheet by the transferring unit 10 so as to thermally fuse and fix the four-color toner image on the sheet. The surface potential distribution and the non-transferred toner remaining on the photosensitive body 1 after transfer are removed by the charge elimination lamp 21 as well as the charge elimination corona unit 12 and by the cleaner 12, respectively. The developing bias units for the first, second and third developing units 4, 5, 7 are controlled and reduced so that the first to third color toners do not adhere during the second rotation of the photosensitive body 1.

The printing speed in this embodiment becomes ½ of the embodiment shown in FIG. 20. However, since one exposure 6 functions as both the second and third exposures 6 and 52 only two exposure (for example, 3 and 6) are required, so that the number of exposure units can be reduced and the apparatus can be made more compact, as a whole.

It is further possible to employ the construction wherein one exposure 3 functions as all of the first to third exposures 3, 6, and 52 and the color image is formed in the third rotation of the photosensitive body 1. In this case, the printing speed drops to ⅓, but since one exposure 3 functions as all of the first to third exposures 3, 6, and 52, only one exposure (for example, 3) is required so that the number of the exposure units can be further reduced and the apparatus can be made even more compact as a whole.

Though the foregoing embodiments have been explained about the apparatuses using the photosensitive drum as the latent image support, the object of the present invention can obviously be accomplished by a photosensitive belt or other alternatives. Though the foregoing embodiments have been explained about the construction wherein the image is directly transferred from the photosensitive drum to the sheet by way of example, the present invention can use an intermediate transfer member such as a transfer drum.

Further, though the foregoing embodiments have been explained about the construction wherein the color printing condition setting unit 24, the second exposure control unit 9, etc., are integral with the apparatus portions for effecting charging, image exposing and development on the latent image support, the color printing condition setting unit 24, the second exposure control, unit 9, etc., may of course be separate and spaced apart from the apparatus portions for forming the toner image.

The present invention can be applied to an image formation system connected to a printer, a copying machine, an electronic computer, etc., and various other products.

The present invention can prevent unintended color mixture in a multi-color image, particularly in a four-color image of yellow, magenta, cyan and black. Accordingly, the present invention can form an image which can be printed clearly at a high speed.

The present invention can make one-path color printing, and provides a high speed color image formation apparatus.

The present invention can constitute a compact color image formation apparatus comprising one charging unit and at most two exposure units.

Since the present invention can arrange dots having different colors adjacent to each side of a triangular dot, it can make full color printing having high reproducibility of intermediate tones by the combination of colors.

What is claimed is:

1. An image formation method comprising:

a charging step for charging a surface of a latent image support to a predetermined potential;

an image exposing step for forming a charge latent image on said latent image support by image exposure;

a developing step for forming a plurality of toner images of a plurality of colors from said charge latent image with a plurality of developing means; and a transferring step for collectively transferring said toner images of said colors to a to-be-transferred member;

wherein said image exposing step includes a plurality of image exposing steps;

wherein said charging step consists of a single charging step performed before all of said image exposing steps;

wherein said developing step includes a plurality of developing steps;

wherein at least a first developing step of said developing steps is carried out after a first image exposing step of said image exposing steps to form a toner image area including at least a first toner image of said toner images of at least a first color of said colors; and wherein at least one of said image exposing steps other than said first image exposing step is carried out after said at least a first developing step to expose at least a Portion of said toner image area formed by said at least a first developing step to shift a potential of said at least a portion of said toner image area, and to expose at least a portion of a background area on said latent image support to form at least one charge latent image for at least one of said colors other than said at least a first color.

2. An image formation method comprising:

a charging step for charging a surface of a latent image support to a predetermined potential;

an image exposing step for forming a charge latent image on said latent image support by image exposure;

a developing step for forming a plurality of toner images of a plurality of colors from said charge latent image with a plurality of developing means; and a transferring step for collectively transferring said toner images of said colors to a to-be-transferred member;

wherein said image exposing step includes a first image exposing step and a second image exposing step;

wherein said charging step consists of a single charging step performed before both of said first image exposing step and said second image exposing step;

wherein said developing step includes a plurality of developing step;

wherein at least a first developing step of said developing steps is carried out after said first image exposing step and before said second image exposing step to form a toner image area including at least a first toner image of said toner images of at least a first color of said colors; and wherein said second image exposing step is carried out after said at least a first developing step to expose at least a portion of said toner image area formed by said at least a first developing step to shift a potential of said at least a portion of said toner image area, and to expose at least a portion of a background area on said latent image support to form at least one charge latent image for at least one of said colors other than said at least a first color.

3. An image formation method according to claim 1, wherein said image exposing step includes a first image exposing step and a second image exposing step.

4. An image formation method according to claim 1, wherein said image exposing step includes a first image exposing step, a second image exposing step, and a third image exposing step, and at least one of said second and third image exposing steps exposes said at least a portion of said toner image area to shift said potential of said at least a portion of said toner image area.

5. An image formation method according to claim 1, wherein said image exposing step includes a first image exposing step, a second image exposing step, a third image exposing step, and a fourth image exposing step, and at least one of said second, third, and fourth image exposing steps exposes said toner image area to shift said potential of said at least a portion of said toner image area.

6. An image formation method according to claim 2, wherein said at least a first developing step is carried out with normal development;

wherein said second image exposing step shifts said potential of said at least a portion of said toner image area formed by said at least a first developing step carried out with normal development to a potential substantially equal to a potential of said background area; and wherein at least one of said developing steps other than said at least a first developing step is carried out after said second image exposing step with normal development.

7. An image formation method according to claim 2, wherein said charging step, said first image exposing step, said at least a first developing steps said second image exposing step, said at least one of said developing steps other than said at least a first developing step and said transferring step are sequentially carried out while said latent image support rotates not more than once.

8. An image formation method according to claim 2, wherein said first image exposing step forms a charge latent image having at least three levels of potential.

9. An image formation method according to claim 2, further comprising:

a potential detecting step for detecting a potential of said toner image area formed by said at least a first developing step: and a step of controlling an exposure quantity during said second image exposing step on the basis of said detected potential of said toner image area.

10. An image formation method according to claim 2, wherein said charge latent image formed by said image exposing step is constituted by a plurality of triangular dots formed in such a manner that positions of apexes of ones of said triangular dots adjacent to one another in a main scanning direction of exposure are mutually opposite in a sub-scanning direction of exposure.

11. An image formation method comprising:

a charging step for charging a surface of a latent image support to a predetermined potential;

an image exposing step for forming a charge latent image on said latent image support by image exposure;

a developing step for forming toner images of a plurality of colors for said charge latent image by a plurality of developing means; and a transferring step for collectively transferring said toner images of a plurality of colors to a to-be-transferred member;

wherein said image exposing step includes a first image exposing step and a second image exposing step;

wherein said charging step consists of a single charging step performed before both of said first image exposing step and said second image exposing step;

wherein said developing step of at least one of said colors is carried out after said first image exposing step and then said second image exposing step is carried out; and wherein a toner image area formed by said developing step of said at least one color is exposed in said second image exposing step and charge latent images for the other colors are formed by selectively shifting a potential of said toner image area.

12. An image formation apparatus comprising:

a latent image support;

charging means for charging a surface of said latent image support to a predetermined potential;

image exposing means for forming a charge latent image on said latent image support by image exposure;

a plurality of developing means for forming toner images of a plurality of colors on said charge latent image; and transferring means for collectively transferring said toner images of a plurality of colors to a to-be-transferred member;

wherein said image exposing means includes first image exposing means and second image exposing means;

wherein said charring means consists of a single charring unit disposed before both of said first image exposing means and said second image exposing means with respect to a direction of movement of said latent image support;

wherein said first image exposing means forms said charge latent image for forming said toner image of at least one color; and wherein said second image exposing means forms charge latent images of other colors by selectively shifting a potential of said toner image area of at least one color formed on said charge latent image area formed by said first image exposing means.

13. An image formation apparatus according to claim 12, wherein said second image exposing means selectively shifts the potential of said toner image area of at least one color to a potential substantially equal to a background area potential.

14. An image formation apparatus according to claim 12, wherein said latent image support is a photosensitive drum.

15. An image formation apparatus according to claim 12, wherein said latent image support is a photosensitive belt.

16. An image formation apparatus according to claim 12, wherein said charging means, said first and second image exposing means, a plurality of said developing means, and said transferring means are disposed around said latent image support, and sequentially carry out a series of said steps ranging from said charging step to said transferring step while said latent image support rotates not more than once.

17. An image formation apparatus according to claim 16, wherein said developing means includes four developing means, forms toner images of yellow, magenta, cyan, and black on said to-be-transferred member while said latent image support rotates not more than once, and a color image is formed by the synthesis of said toner images.

18. An image formation apparatus according to claim 12, wherein said first image exposing means forms charge latent images of at least three levels.

19. An image formation apparatus according to claim 12, which further comprises potential detection means for detecting the potential of said latent image support, and wherein said second image exposing means carries out image exposure by controlling an exposure quantity on the basis of a detection value of the potential of said toner image area of said at least one color by said potential detection means.

20. An image formation apparatus according to claim 12, wherein said first and second image exposing means form latent image dots having a latent image shape of a plurality of triangular dots in such a manner that positions of apexes of said dots are mutually opposite in a sub-scanning direction of image exposure between said dots adjacent to one another in a main scanning direction of image exposure.

21. An image formation apparatus comprising a latent image support, and being equipped, sequentially around said latent image support in a rotating direction of said latent image support, with:

charging means for charging a surface of said latent image support;

first image exposing means for forming a charge latent image on said latent image support by image exposure;

one or a plurality of developing means for forming a toner image of at least one color for said charge latent image formed by said first image exposing means;

second image exposing means for forming a charge latent image for said latent image support by image exposure;

one or a plurality of developing means for forming a toner image of at least one color for said charge latent image formed by said second image exposing means; and transferring means for collectively transferring said toner images of a plurality of colors formed on said latent image support to a to-be-transferred member;

wherein said charging means consists of a single charging unit disposed before both of said first image exposing means and said second image exposing means with respect to a direction of movement of said latent image support; and wherein said first image exposing means forms said charge latent image for forming said toner image of at least one color, said second image exposing means forms charge latent images for forming said toner images of the other colors by selectively shifting a potential of a toner image area of at least one color formed on said charge latent image area formed by said first image exposing means, to a potential substantially equal to a background area potential, and a series of process steps ranging from charging to transfer are sequentially carried out while said latent image support rotates not more than once.

22. An image formation method comprising:

a charging step for charging a surface of a latent image support to a predetermined potential;

an image exposing step for forming a charge latent image on said latent image support by image exposure;

a developing step for forming toner images of a plurality of colors for said charge latent image by a plurality of developing means; and a transferring step for collectively transferring said toner images of said plurality of colors to a to-be-transferred member; and wherein said image exposing step is an image exposing step for forming charge latent images of five levels;

wherein said charging step consists of a single charging step performed before every portion of said image exposing step; and wherein said developing step for forming a toner image of at least one of said colors is carried out, then a step of shifting the potential of a toner image area thus formed to a potential substantially equal to a background area potential is carried out, and then said developing step for forming toner image images of remaining ones of said colors is carried out.

23. An image formation method according to claim 22, wherein a light-absorptive toner is developed by inverse development in said developing step for forming a toner image of at least one of said colors; and wherein in said step of shifting the potential of said toner image area thus formed to a potential substantially equal to said background area potential, light having a wavelength capable of being absorbed by said light-absorptive toner is uniformly irradiated to said latent image support and the potential of said toner image area is shifted to a potential substantially equal to said background area potential.

24. An image formation apparatus comprising:

a latent image support;

charging means for charging a surface of said latent image support to a predetermined potential;

image exposing means for forming charge latent images of five levels on said latent image support by image exposure;

four developing means for forming toner images of four colors for said charge latent images;

transferring means for collectively transferring said toner images of the four colors to a to-be-transferred member; and potential shift means for shifting a potential of said toner image area to a potential substantially equal to a background area potential after said developing step of said toner image area of at least one color is carried out;

wherein said charging means consists of a single charging unit disposed before every portion of said image exposing means with respect to a direction of movement of said latent image support.

25. An image formation apparatus according to claim 24, wherein said potential shift means is a lamp for uniformly irradiating light to said latent image support.

26. An image formation method comprising:

a step for charging a surface of a latent image support to a predetermined potential;

a step of forming a charge latent image on said latent image support by image exposure;

a developing step of forming a toner image for said charge latent image by developing means; and a step of transferring said toner image to a to-be-transferred member;

wherein a plurality of triangular dots are formed by said step of forming said charge latent image on said latent image support in such a manner that positions of apexes of said triangular dots are mutually opposite in a sub-scanning direction of exposure between said dots adjacent to one another in a main scanning direction of exposure.

27. An image formation method according to claim 26, wherein toner images of yellow, magenta, cyan, and black are developed for a plurality of said triangular dots, respectively, and toner images having mutually different colors are developed between said dots adjacent to one another, respectively.

28. An image formation method comprising:

charging a surface of a latent image support to a predetermined potential;

forming a charge latent image on said latent image support by image exposure;

forming a toner image for said charge latent image by developing means;

transferring said toner image to a to-be-transferred member; and forming a full color image constituted by a plurality of triangular toner dots comprising yellow, magenta, cyan, and black toner images, respectively, and spread in such a manner that the colors of said dots have mutually different colors between said dots adjacent to one another, on said to-be-transferred member.

29. A full color image formation method comprising:

a step of charging a surface of a latent image support to a predetermined potential;

a step for forming charge latent images of five levels by one image exposing operation;

a developing step of forming monochromatic images of yellow, magenta, and cyan and a mixed color image of a yellow toner and a black toner on said charge latent image by a plurality of developing means; and a step of collectively transferring said toner images of a plurality of colors to a to-be-transferred member.

30. An image formation apparatus comprising a latent image support, and being equipped, sequentially around said latent image support in a rotating direction of said latent image support, with:

charging means for charging a surface of a surface of said latent image support to a predetermined potential;

first exposing means for forming a charge latent image on said latent image support by image exposure;

first and second developing means for forming toner images on said latent image support;

second image exposing means for forming a charge latent image on said latent image support by image exposure, said second image exposing means selectively shifting a potential of at least a portion of said toner images formed by said first and second developing means;

third and fourth developing means for forming toner images on said latent image support; and transferring means for transferring said toner images formed on said latent image support to a to-be-transferred member;

wherein said charging means consists of a single charging unit disposed before both of said first image exposing means and said second image exposing means with respect to a direction of movement of said latent image support; and wherein a series of process steps from charging to transfer are sequentially carried out and a toner image comprising yellow, magenta, cyan, and black is formed while said latent image support rotates not more than once.

31. An image formation method according to claim 2, wherein after said first image exposing step, said developing step of a first one of said colors and said developing step of a second one of said colors are performed with normal development and inverse development, respectively, or are performed with inverse development and normal development, respectively; and wherein after said second image exposing step, said developing step of a third one of said colors and said developing step of a fourth one of said colors are performed with normal development and inverse development, respectively, or are performed with inverse development and normal development, respectively.

32. An image formation method according to claim 1, wherein in said subsequent ones of said image exposing steps, said toner image area is exposed with light controlled to have at least two intensities.

33. An image formation method comprising:

a charging step for charging a surface of a latent image support to a predetermined potential;

a plurality of image exposing steps for forming on said latent image support a plurality of charge latent images for a plurality of colors by a plurality of image exposures;

a plurality of developing steps for forming on said latent image support a plurality of toner images of a plurality of colors from said charge latent images with a plurality of developing means, each of said developing steps forming on said latent image support a toner image area including one of said toner images of one of said colors; and a transferring step for collectively transferring said toner images of said colors to a to-be-transferred member;

wherein said plurality of image exposing steps include at least a first image exposing step and a second image exposing step;

wherein said charging step consists of a single charging step performed before all of said image exposing steps;

wherein at least one of said developing steps is carried out between said first image exposing step and said second image exposing step;

wherein any portion of said latent image support on which no toner image area has been formed constitutes a background area of said latent image support; and wherein said second image exposing step and any of said image exposing steps subsequent to said second image exposing step include exposing at least a portion of said background area of said latent image support with a first exposure intensity to form at least one of said charge latent images for at least one of said colors, and exposing at least a portion of at least one toner image area formed by at least one of said developing steps with a second exposure intensity different from said first exposure intensity to selectively shift a potential of said at least one toner image area and/or to form at least one of said charge latent images for at least one of said colors.

34. An image formation method according to claim 33, wherein image exposing steps include an image exposing step for forming charge latent images of at least three potential levels.

* * * * *